US010766285B2

(12) United States Patent
Ushiama

(10) Patent No.: US 10,766,285 B2
(45) Date of Patent: Sep. 8, 2020

(54) PRINTING APPARATUS AND PRINTING METHOD

(71) Applicant: SEIKO EPSON CORPORATION, Tokyo (JP)

(72) Inventor: Jun Ushiama, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/368,292

(22) Filed: Mar. 28, 2019

(65) Prior Publication Data

US 2019/0299679 A1 Oct. 3, 2019

(30) Foreign Application Priority Data

Mar. 29, 2018 (JP) ..... 2018-063743

(51) Int. Cl.

| | |
|---|---|
| ***B41J 11/00*** | (2006.01) |
| ***B41J 15/16*** | (2006.01) |
| ***B41J 13/00*** | (2006.01) |
| ***B41J 2/01*** | (2006.01) |
| ***B41J 11/02*** | (2006.01) |

(52) U.S. Cl.

CPC ..... *B41J 15/165* (2013.01); *B41J 2/01* (2013.01); *B41J 11/0095* (2013.01); *B41J 11/02* (2013.01); *B41J 13/0009* (2013.01)

(58) Field of Classification Search

CPC . B41J 15/00; B41J 15/005; B41J 15/16; B41J 15/165; B41J 15/0095; B41J 15/0075; B41J 13/0009

See application file for complete search history.

(56) References Cited

U.S. PATENT DOCUMENTS

2012/0321366 A1* 12/2012 McLaughlin ..... B41J 15/165 400/583
2015/0273881 A1* 10/2015 Momose ..... B41J 3/4078 347/102
2017/0165986 A1* 6/2017 Kakimoto ..... B65H 23/1888
2017/0348988 A1* 12/2017 Nakata ..... B41J 15/046

FOREIGN PATENT DOCUMENTS

JP 2016-147380 A 8/2016

* cited by examiner

*Primary Examiner* — Scott A Richmond
(74) *Attorney, Agent, or Firm* — Foley & Lardner LLP

(57) ABSTRACT

A printing apparatus includes a transporting unit that transports a printing medium, a transporting unit encoder that outputs a movement amount information indicating a movement amount of the printing medium, a medium winding unit disposed downstream of the guide member with respect to the transporting unit and winds the printing medium, a tension applying unit including a tension bar that presses the printing medium at a location between the transporting unit and the medium winding unit while the tension bar is moving between an upper limit position and a lower limit position and applies tension to the printing medium, a tension applying unit encoder that outputs a rod member location information indicating a position of the tension bar, and a control unit that determines a movement state of the printing medium at the tension applying unit, based on the movement amount information and the rod member location information.

6 Claims, 20 Drawing Sheets

| MEDIUM NAME | MATERIAL | THICKNESS (mm) | ANGLE VARIATION DETERMINATION VALUE (°) | PRESSING FORCE DETERMINATION VALUE (N) | PRESSING FORCE INCREASE AMOUNT (N) | PRESSING FORCE REDUCTION PATTERN |
|---|---|---|---|---|---|---|
| A-1 | POLYETHYLENE | 0.2 | 2 | 8 | 0.5 | 2 |
| A-2 | POLYETHYLENE | 0.3 | 2 | 10 | 0.5 | 1 |
| A-3 | POLYPROPYLENE | 0.2 | 2 | 7 | 0.5 | 3 |
| B-1 | HIGH-QUALITY PAPER | 0.2 | 2 | 8 | 0.5 | 1 |
| B-2 | HIGH-QUALITY PAPER | 0.3 | 2 | 10 | 0.5 | 1 |
| B-3 | PLAIN PAPER | 0.2 | 2 | 8 | 0.5 | 1 |
| ⋮ | ⋮ | ⋮ | ⋮ | ⋮ | ⋮ | ⋮ |

FIG. 27

PRINTING APPARATUS AND PRINTING METHOD

The present application is based on, and claims priority from JP Application Serial Number 2018-063743, filed Mar. 29, 2018, the disclosure of which is hereby incorporated by reference herein in its entirety.

BACKGROUND

1. Technical Field

The present disclosure relates to a printing apparatus and a printing method.

2. Related Art

Printing apparatuses that perform printing of images and letters by ejecting ink from a printing head onto a medium are widely used. A medium, such as paper, cloth and a sheet, is transported by a transportation roller pair disposed upstream of the printing head in the transportation direction. In this case, due to static electricity charged in the medium and the like, a part of the medium may adhere to the transportation surface of a transportation guide. Consequently, transportation of the medium may fail.

At a location upstream of a location where the medium is stuck, the medium forms a protruding portion due to buckling of the medium. Further, when the medium is supplied, the protruding portion is further enlarged. When being pushed into a narrow area, the protruding portion may creases or wrinkles This state is called jam. Further, when the protruding portion contacts with the printing head, the medium may stain.

JP-A-2016-147380 discloses a recording device for suppressing formation of the protruding portion. According to this, the recording device includes a sending unit that sends a medium. The sending unit sends the medium to a downstream side. Then, a winding unit winds and collects the medium at a location downstream of the sending unit. The sending unit and the winding unit alternately operate. Even when the sending unit sends the medium and the protruding portion is formed, the winding unit winds the medium before the protrusion is enlarged. In this manner, formation of the protruding portion is suppressed by alternately performing the sending and winding of the medium.

The recording device disclosed in JP-A-2016-147380 cannot detect transportation failures of the medium. When a transportation failure (jam) of the medium occurs, the protruding portion is enlarged. When the protruding portion is enlarged, the medium may be damaged, and the medium may make contact with the printing head, thus causing printing failure. In view of this, a printing apparatus that can detect transportation failures of the medium has been desired.

SUMMARY

A printing apparatus of the present application includes a transporting unit configured to transport a medium along a guide member, a winding unit disposed further downstream of the guide member than the transporting unit and configured to wind the medium, a tension applying unit including a rod member configured to press the medium between the transporting unit and the winding unit and apply tension to the medium while moving between an upper limit position and a lower limit position, and a control unit including a first detecting unit configured to detect a movement amount of the medium, and a second detecting unit configured to detect a movement amount of the rod member. The control unit detects the movement amount of the rod member every time the transporting unit transports the medium by a predetermined length, and detects a transportation failure of the medium when the movement amount of the rod member is smaller than a determination value.

Preferably, in the printing apparatus, a winding amount of the medium wound by the winding unit is controlled such that the medium passes through a location where the rod member is able to press the medium.

Preferably, the printing apparatus includes a driving unit configured to drive the tension applying unit, and when a transportation failure of the medium is detected, the control unit controls the driving unit such that a force that the tension applying unit applies to press the medium becomes greater than a force that has been applied at a time of detecting the transportation failure of the medium.

Preferably, in the printing apparatus, when no transportation failure of the medium is detected after the tension applying unit has intensified the force applied to press the medium, the control unit controls the driving unit to maintain the intensified force to press the medium.

Preferably, in the printing apparatus, when no transportation failure of the medium is detected after the tension applying unit has intensified the force applied to press the medium, the control unit controls the driving unit such that the force applied to press the medium is returned to the force that has been applied at the time of detecting the transportation failure of the medium.

A printing method of the present application includes transporting a medium along a guide member by a transporting unit, winding the medium by a winding unit further downstream of the guide member than the transporting unit, pressing the medium, between the transporting unit and the winding unit, by a rod member to apply tension to the medium by a rod member while moving the rod member between an upper limit position and a lower limit position, detecting a movement amount of the medium by a first detecting unit, and detecting a movement amount of the rod member by a second detecting unit, and the movement amount of the rod member is detected every time the transporting unit transports the medium by a predetermined length, and a transportation failure of the medium is detected when the movement amount of the rod member is smaller than a determination value.

BRIEF DESCRIPTION OF THE DRAWINGS

FIG. 27 is a drawing illustrating determination data and tension-related data in a printing medium.

DESCRIPTION OF EXEMPLARY EMBODIMENTS

Figure 1:
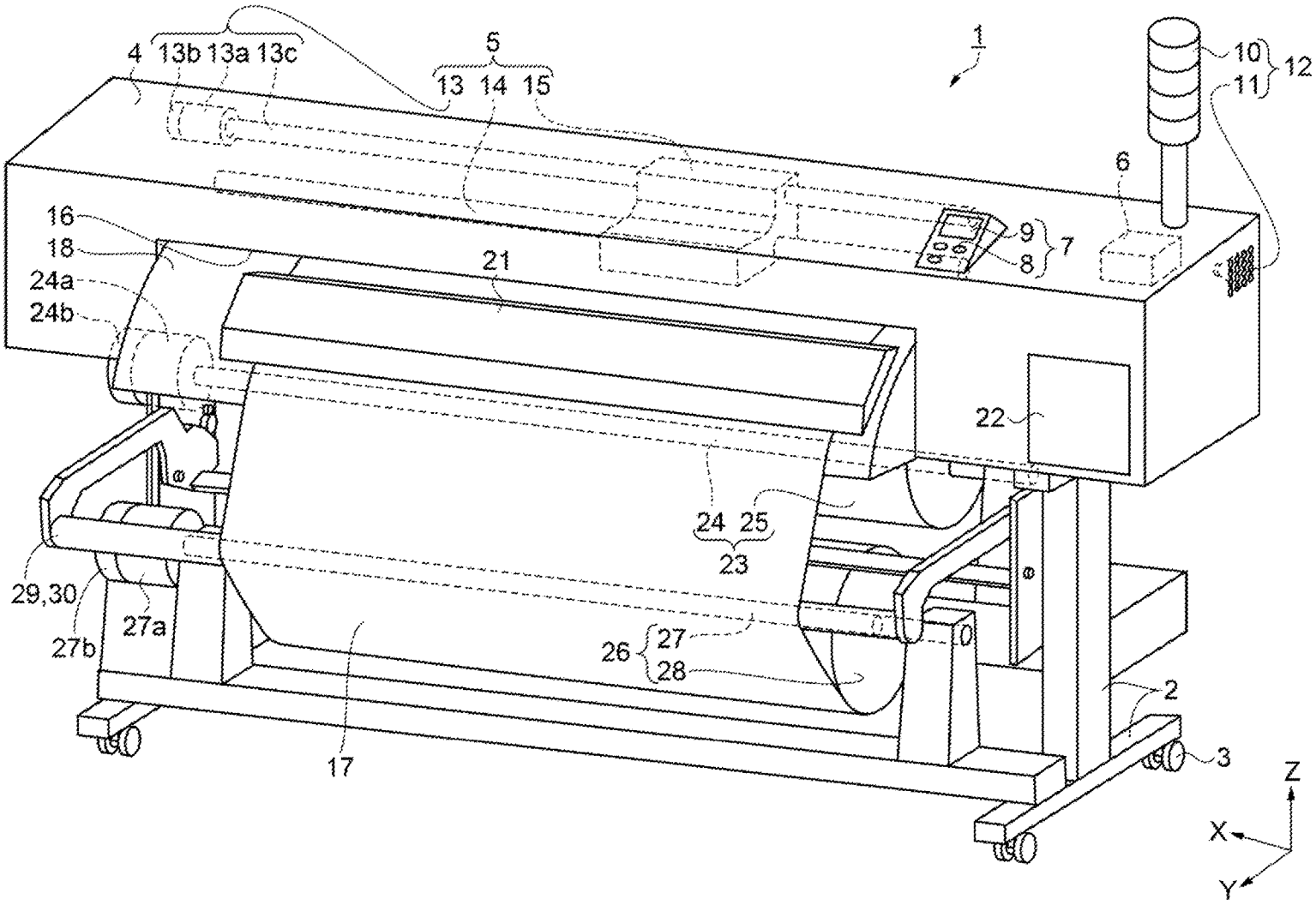
FIG. 1 is a schematic perspective view illustrating a structure of a printing apparatus according to a first exemplary embodiment.

Exemplary embodiments are described below with reference to the drawings. Note that the scales of the members illustrated in the drawings are changed for illustration in each drawing.

First Exemplary Embodiment

In the present exemplary embodiment, exemplary features of a printing apparatus are described with reference to the drawings. A printing apparatus and a printing method according to the first exemplary embodiment are described with reference to FIG. 1 to FIG. 22. FIG. 1 is a schematic perspective view illustrating a structure of the printing apparatus. As illustrated in FIG. 1, a printing apparatus 1 is an ink-jet printing apparatus of a large format of a roll-to-roll type that handles a relatively large printing medium. The printing apparatus 1 has a long shape in one direction along a horizontal direction. The longitudinal direction of the printing apparatus 1 is set as an X direction, and the left side in the drawing is set as the +X direction. A direction orthogonal to the X direction along a horizontal direction is set as a Y direction. A gravitational acceleration direction is set as a −Z direction.

The printing apparatus 1 includes a leg part 2. A wheel 3 is provided on the −Z direction side of the leg part 2 and thus the printing apparatus 1 is movable. The wheel 3 is provided with a lock function that is not illustrated, and the rotation of the wheel 3 can be prohibited when the printing apparatus 1 is used. A housing part 4 is provided on the +Z direction side of the leg part 2, and a control unit 6 configured to control the printing apparatus 1 and a printing unit 5 and the like are provided inside the housing part 4.

An operation panel 7 is provided at a position on the −X direction side and on the +Z direction side of the housing part 4. The operation panel 7 includes an operation unit 8 and a display unit 9. The operation unit 8 is composed of a push switch and the like. When inputting a printing condition and the like and providing various instructions, an operator operates the operation unit 8. The display unit 9 is composed of a liquid crystal display device and the like. A transportation condition setting screen and the like are displayed on the display unit 9.

A notification light 10 is provided on the −X direction side with respect to the operation panel 7. In the notification light 10, a blue light, a green light, a yellow light and a red light are disposed side by side in the Z direction. The control unit 6 lights a light of a predetermined color in accordance with the state of the printing apparatus 1 to notify the operator of the state of the printing apparatus 1. A speaker 11 is provided in a side surface on the −X direction side of the housing part 4. The control unit 6 outputs a predetermined sound in accordance with the state of the printing apparatus 1 to notify the operator of the state of the printing apparatus 1. A notification unit 12 includes the notification light 10, the speaker 11 and the like.

A carriage moving unit 13, a guide rail 14 and a carriage 15 are provided in the printing unit 5. The carriage moving unit 13 includes a screw shaft 13*c*, a motor 13*a*, and an encoder 13*b*. In the carriage 15, many printing heads configured to eject ink in the form of ink drops are provided. The printing heads that are not illustrated in the drawing. Each of the screw shaft 13*c* and the guide rail 14 has a long rod shape extending in the X direction, and the carriage 15 moves along the screw shaft 13*c* and the guide rail 14. The screw shaft 13*c* is provided with the motor 13*a* and the encoder 13*b*. The carriage 15 is provided with a nut for thread engagement with the screw shaft 13*c*. A ball screw is composed of the nut, the screw shaft 13*c* and the like. When the motor 13*a* rotates the screw shaft 13*c*, the carriage 15 moves in the X direction. The encoder 13*b* detects the rotation angle of the screw shaft 13*c*, and thus the position of the carriage 15 can be detected.

An outlet 16 is provided on the +Y direction side of the housing part 4, and a printing medium 17 is output from the outlet 16 as a medium printed by the printing unit 5. A downstream side guide part 18 is provided on the −Z direction side of the outlet 16. The downstream side guide part 18 guides the printing medium 17 output from the outlet 16. An infrared ray heater 21 is provided at a location opposite the downstream side guide part 18. The printing medium 17 passes between the downstream side guide part 18 and the infrared ray heater 21. The infrared ray heater 21 heats and dries the ink applied on the printing medium 17.

An ink mounting part 22 is provided on the −X direction side of the downstream side guide part 18. Ink is stored in the ink mounting part 22. The ink is supplied to the printing heads of the carriage 15 through a tube that is not illustrated. The ink is ejected from the printing heads to the printing medium 17.

A medium supply unit 23 is provided on the −Y direction side of the leg part 2. The medium supply unit 23 supplies the printing medium 17 to the printing unit 5. The medium supply unit 23 includes a supply shaft 24. The printing medium 17 is wound around the supply shaft 24, and thus a supply side roll body 25 is formed. The supply shaft 24 is provided with a supply motor 24*a* and a supply unit encoder 24*b*. When the supply motor 24*a* rotates the supply shaft 24, the printing medium 17 is supplied to the printing unit 5 from the supply side roll body 25. The supply unit encoder 24*b* detects the rotation angle of the supply shaft 24, and thus the supply amount of the printing medium 17 can be detected.

As a winding unit, a medium winding unit 26 is provided on the +Y direction side of the leg part 2. The medium winding unit 26 winds the printing medium 17 output from the outlet 16. The medium winding unit 26 includes a winding shaft 27. The printing medium 17 is wound around the winding shaft 27, and thus a winding side roll body 28 is formed. The winding shaft 27 is provided with a winding motor 27*a* and a winding unit encoder 27*b*. When the winding motor 27*a* rotates the winding shaft 27, the printing medium 17 is wound around the winding side roll body 28. The winding unit encoder 27*b* detects the rotation angle of the winding shaft 27, and thus the winding amount of the printing medium 17 can be detected.

A tension applying unit 29 is provided between the downstream side guide part 18 and the winding side roll body 28. The tension applying unit 29 includes a tension bar 30 as a rod member. The tension bar 30 is a long rod-shaped member extending in the X direction, and applies constant tension to the printing medium 17. With this configuration, the tension bar 30 suppresses the occurrence of wrinkles on the printing medium 17.

Figure 2:
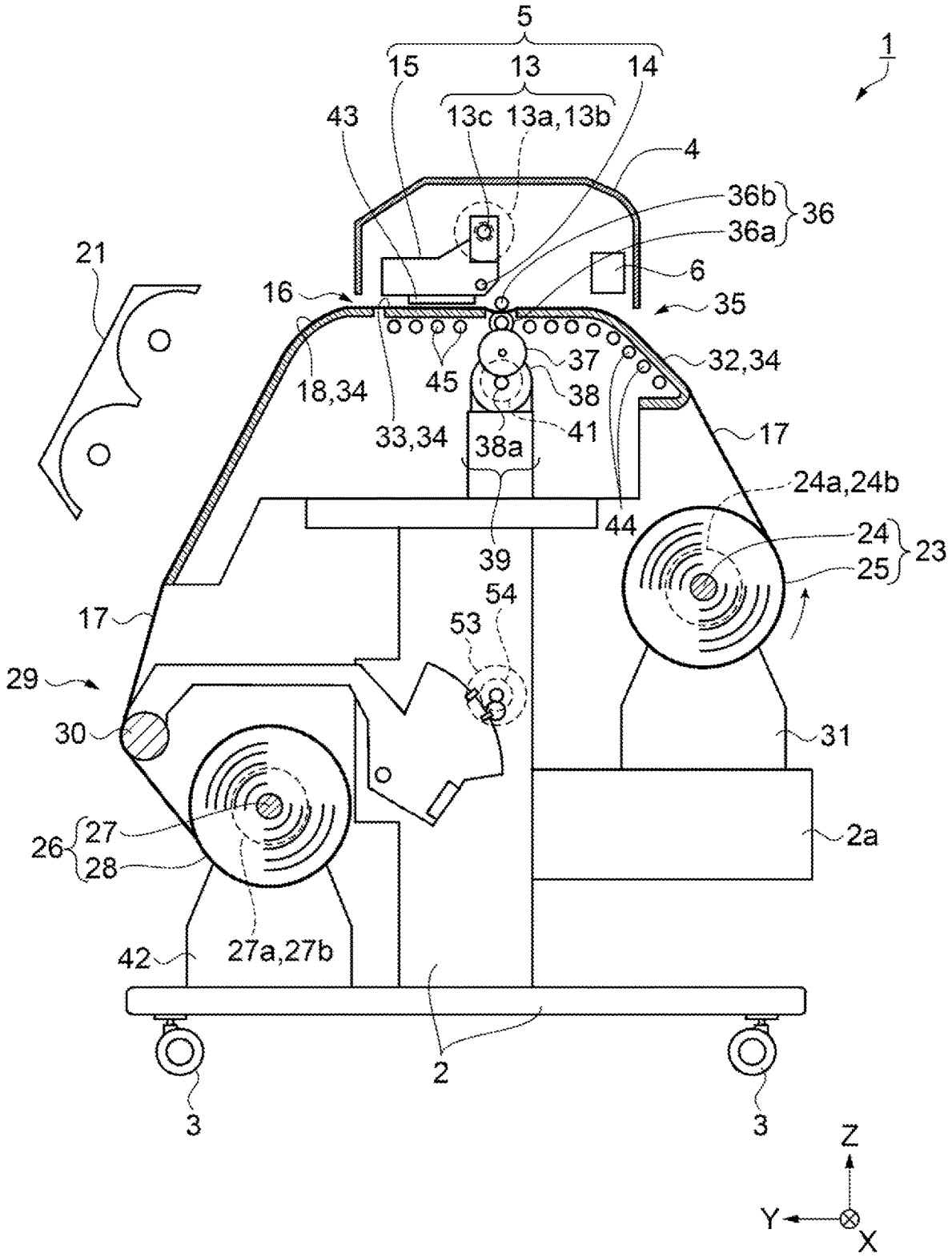
FIG. 2 is a schematic side sectional view illustrating a structure of the printing apparatus.

FIG. 2 is a schematic side sectional view illustrating a structure of the printing apparatus. As illustrated in FIG. 2, the leg part 2 is provided with a support base 2*a* protruding in the −Y direction at a middle portion of the leg part 2 in the Z direction. A supply shaft supporting part 31 is provided on the support base 2*a*. The supply shaft supporting part 31 supports the supply shaft 24, the supply motor 24*a* and the supply unit encoder 24*b*.

In the medium supply unit 23, the supply motor 24*a* rotates the supply side roll body 25 in a counterclockwise direction with the X direction as an axis. With this configuration, the printing medium 17 is supplied to the printing unit 5 from the supply side roll body 25. Note that the printing medium 17 includes various types of printing mediums, and the types of the printing medium 17 are roughly categorized into a paper type and a film type. Specific examples of the paper type include a high-quality paper, cast paper, art paper, coated paper and the like, and specific examples of the film type include synthetic paper, polyethylene terephthalate (PET), polypropylene (PP) and the like.

A guide member 34, in which an upstream guide part 32, a platen 33 and the downstream side guide part 18 are arranged in this order from the −Y direction side toward the +Y direction side, is provided between the housing part 4 and the leg part 2. The guide members 34 in the upstream side guide part 32, the platen 33 and the downstream side guide part 18 respectively guide the printing medium 17.

A supply port 35 is provided between the upstream guide part 32 and the housing part 4. The printing medium 17 supplied from the medium supply unit 23 is guided to the supply port 35 through the upstream side guide part 32. A transportation roller 36 is provided between the upstream side guide part 32 and the platen 33. The transportation roller 36 includes a transportation driving roller 36*a* and a transportation driven roller 36*b*. The transportation driving roller 36*a* and the transportation driven roller 36*b* extend in the X direction intersecting the +Y direction, which is the movement direction of the printing medium 17. The transportation driving roller 36*a* is disposed on the −Z direction side of the guide member 34. The transportation driven roller 36*b* is disposed on the +Z direction side with respect to the transportation driving roller 36*a*. The transportation driven roller 36*b* rotates to follow the rotation of the transportation driving roller 36*a*.

The transportation roller 36 includes a spring that is not illustrated. The spring presses the transportation driven roller 36*b* against the transportation driving roller 36*a*. With the transportation driven roller 36*b* pressed against the transportation driving roller 36*a*, the transportation roller 36 rotates while sandwiching the printing medium 17 to send the printing medium 17 to the printing unit 5 in the +Y direction.

An intermediate gear 37 and a transportation motor 38 are provided on the −Z direction side of the transportation roller 36. The transportation motor 38 is provided with a transporting unit encoder 41 as a first detecting unit, and the transporting unit encoder 41 detects the rotation angle of a shaft 38*a* of the transportation motor 38. Teeth are formed on the shaft of the transportation driving roller 36*a*, the outer periphery of the intermediate gear 37 and the shaft 38*a* of the transportation motor 38. With this configuration, the shaft 38*a* of the transportation motor 38 and the outer periphery of the intermediate gear 37 are meshed with each other, and the outer periphery of the intermediate gear 37 and the shaft of the transportation driving roller 36*a* are meshed with each other. When the transportation motor 38 rotates the shaft 38*a*, the torque of the transportation motor 38 is transmitted to the transportation driving roller 36*a* via the intermediate gear 37. Accordingly, when the transportation motor 38 is driven and the transportation driving roller 36*a* is driven into rotation, the printing medium 17 sandwiched between the transportation driven roller 36*b* and the transportation driving roller 36*a* is transported in the +Y direction. Note that the transporting unit encoder 41 is a part of the control unit 6.

A transporting unit 39 is composed of the transportation roller 36, the intermediate gear 37, the transportation motor 38 and the like. The transporting unit 39 transports the printing medium 17 along the guide member 34.

The transporting unit encoder 41 detects the rotation angle of the shaft 38*a* of the transportation motor 38 and outputs it to a movement amount computation unit of the control unit 6. By using the number of teeth and the diameter of the transportation driving roller 36*a*, the number of teeth of the intermediate gear 37, the number of teeth of the shaft 38*a* and the rotation angle of the shaft 38*a*, the movement amount computation unit of the control unit 6 determines the movement amount of the contact surface (outer peripheral surface) with the printing medium 17 at the transportation driving roller 36*a*. The movement amount of the outer peripheral surface of the transportation driving roller 36*a* is regarded as the sending amount of the printing medium 17 and is handled as the movement amount of the printing medium 17.

The printing medium 17 that passed by the transportation roller 36 moves along the platen 33. Then, the printing medium 17 past the platen 33 moves along the downstream side guide part 18. The outlet 16 is provided between the downstream side guide part 18 and the housing part 4. The printing medium 17 is output from the outlet 16 of the housing part 4. The printing medium 17 past the outlet 16 moves along the downstream side guide part 18 toward the medium winding unit 26.

The tension bar 30 of the tension applying unit 29 presses the printing medium 17 at a location between the transporting unit 39 and the medium winding unit 26. The tension applying unit 29 has a configuration in which the tension bar 30 moves along the circumference of a circle about a turning axis, which is described later, as a rotation center. The tension bar 30 applies tension to the printing medium 17 while moving between the upper limit position and the lower limit position in a movement range.

The medium winding unit 26 is disposed further toward downstream side of the guide member 34 than the transporting unit 39. The medium winding unit 26 wind the printing medium 17 printed by the printing unit 5 into a cylindrical shape, so as to form the winding side roll body 28. A winding shaft supporting part 42 is provided on the leg part 2. The winding shaft supporting part 42 sandwiches and holds the winding shaft 27. The printing medium 17 is wound around the winding shaft 27 and thus the winding side roll body 28 is formed.

The carriage moving unit 13 provided inside the housing part 4 reciprocates the carriage 15 in the X direction. The X direction in which the carriage 15 moves is referred to as a main scanning direction. The carriage 15 is supported by the screw shaft 13*c* and the guide rail 14 disposed along the X direction. Thus, the carriage 15 can be reciprocated in the ±X direction by the carriage moving unit 13. The mechanism of the carriage moving unit 13 may be a linear guide mechanism and the like as well as the ball screw.

The carriage 15 is provided with a head unit 43. The head unit 43 is provided with a printing head that is not illustrated. The printing head ejects ink drops from a nozzle to the printing medium 17 that is being transported along the platen 33. The printing head of the present exemplary embodiment is referred to also as an ink-jet head.

The printing apparatus 1 includes a first heater 44 and a second heater 45 in addition to the infrared ray heater 21. The first heater 44 is disposed on the −Z direction side of the upstream side guide part 32. The first heater 44 heats the printing medium 17 via the upstream side guide part 32. The second heater 45 heats the printing medium 17 via the platen 33. Since the printing medium 17 is heated, the ink landed on the printing medium 17 is easily dried. The infrared ray heater 21 dries and fixes the ink, which is still not dried, among the ink that is landed on the printing medium, before the printing medium is wound by the medium winding unit 26.

Figure 3:
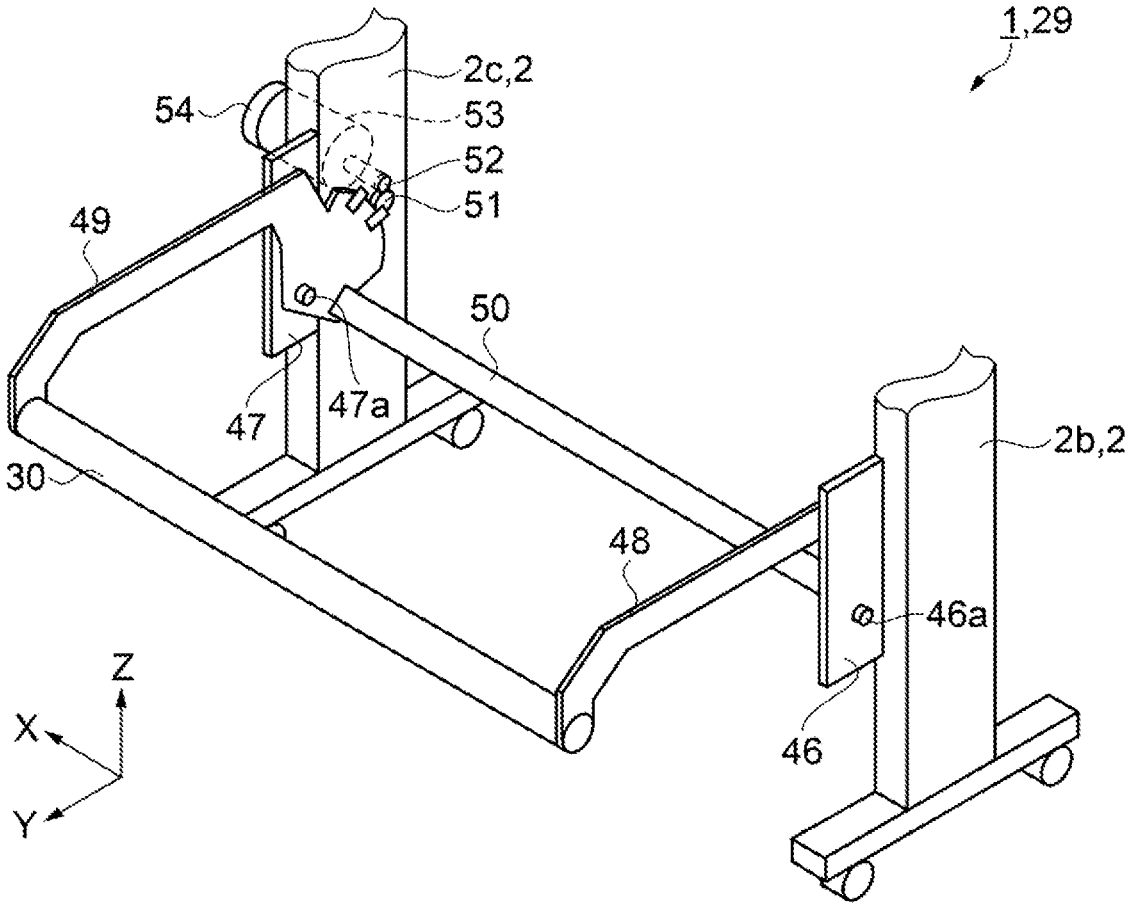
FIG. 3 is a schematic perspective view illustrating a configuration of a tension applying unit.

FIG. 3 is a schematic perspective view illustrating a configuration of the tension applying unit. As illustrated in FIG. 3, the printing apparatus 1 includes a pair of the leg parts 2. The leg part 2 on the −X direction side is a first leg part 2*b*, and the leg part 2 on the +X direction side is a second leg part 2*c*. A first support plate 46 is provided on the +Y direction side of the first leg part 2*b*, and a second support plate 47 is provided on the +Y direction side of the second leg part 2*c*.

The first support plate 46 is provided with a first shaft 46*a*. A first arm part 48 that rotates about the first shaft 46*a* is installed on the first shaft 46*a*. Likewise, the second support plate 47 is provided with a second shaft 47*a*. A second arm part 49 that rotates about the second shaft 47*a* is installed on the second shaft 47*a*.

The tension bar 30 is provided so as to bridge between an end of the first arm part 48 on the +Y direction side and an end of the second arm part 49 on the +Y direction side. Further, a counter weight 50 is provided so as to bridge between the −Y direction side of the first arm part 48 and the −Y direction side of the second arm part 49. The first shaft 46*a* and the second shaft 47*a* are disposed on the same axis. With this configuration, the tension bar 30 and the counter weight 50 rotate about the first shaft 46*a* and the second shaft 47*a* as the turning axes.

The tension bar 30 and the counter weight 50 function as long members that connect the first arm part 48 and the second arm part 49. With this configuration, as viewed in the Z direction, the tension applying unit 29 forms a substantially quadrangular shape with the tension bar 30, the counter weight 50, the first arm part 48 and the second arm part 49 as its four sides. As a result, the torsional rigidity of the tension applying unit 29 is improved, thus achieving a structure in which the tension applying unit 29 is configured to be not easily deformed even when the tension applying unit 29 is pressed by the printing medium 17.

Figure 4:
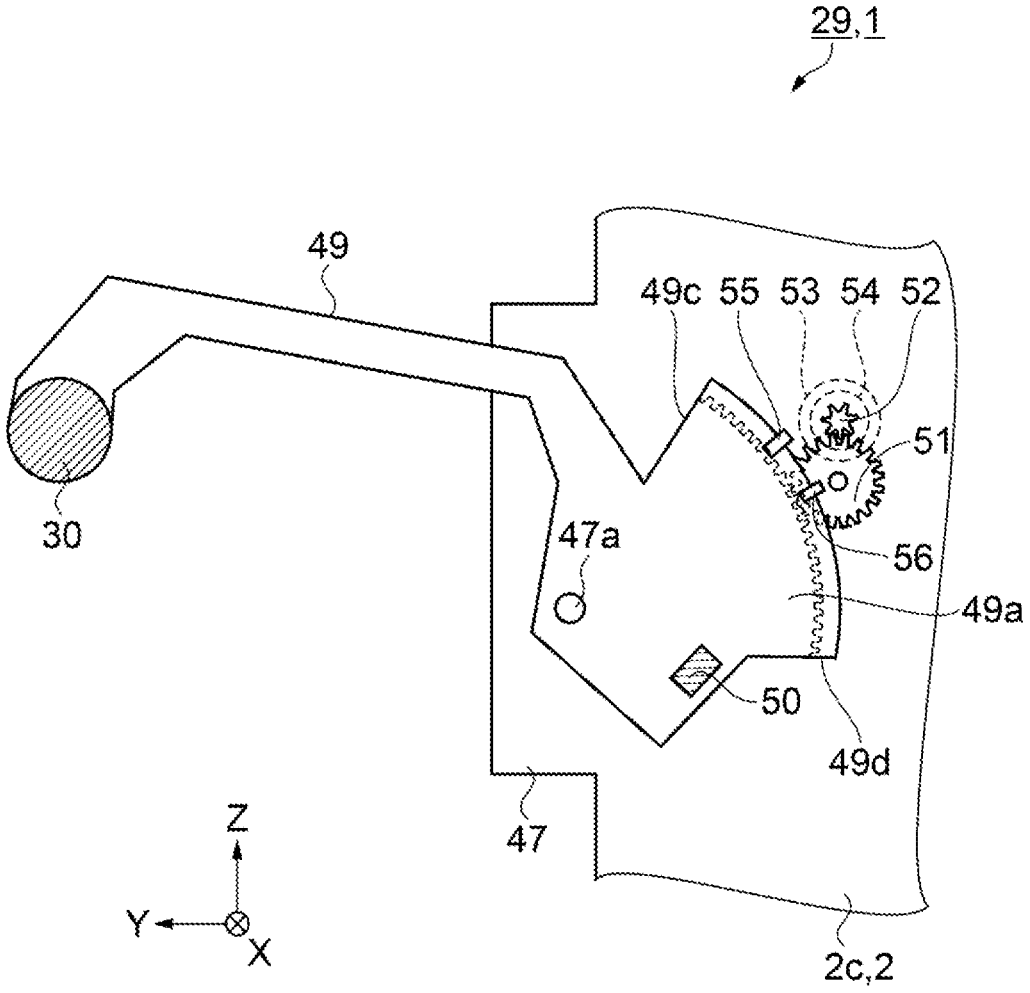
FIG. 4 is a schematic side sectional view illustrating a configuration of the tension applying unit.

FIG. 4 is a schematic side sectional view illustrating a configuration of the tension applying unit. As illustrated in FIG. 4, the second arm part 49 is provided with a flag plate 49*a* having an arc-like end portion on the −Y direction side of the second shaft 47*a*. A gear is formed in the arc-like end portion of the flag plate 49*a*. An intermediate gear 51 that is meshed with the gear of the flag plate 49*a* is provided on the −Y direction side of the gear of the flag plate 49*a*. Further, a driving gear 52 is provided on the +Z direction side of the intermediate gear 51.

As illustrated in FIG. 3, as a driving unit, a tension applying motor 53 is provided on the +X direction side of the second leg part 2*c*. As a second detecting unit, a tension applying unit encoder 54 that detects the rotation angle of the tension applying motor 53 is provided on the +X direction side of the tension applying motor 53. Note that the tension applying unit encoder 54 is a part of the control unit 6. Returning back to FIG. 4, the driving gear 52 is provided on the rotation shaft of the tension applying motor 53. Specifically, the driving gear 52 is formed on the rotation shaft of the tension applying motor 53. When the tension applying motor 53 rotates the driving gear 52, the torque output by the tension applying motor 53 is transmitted to the second arm part 49 via the driving gear 52 and the intermediate gear 51. Then, the second arm part 49 rotates about the second shaft 47*a* as the rotation center. The tension bar 30 moves along a circumference of a circle about the second shaft 47*a* as the rotation center. The tension applying motor 53 rotates in a clockwise direction and a counterclockwise direction, and accordingly the tension bar 30 moves up and down at a position where tension is applied to the printing medium 17.

At the time when the tension bar 30 contacts with the printing medium 17, the torque output by the tension applying motor 53 acts on the tension bar 30. Then, a force that applies tension to the printing medium 17 acts on the tension bar 30. In this manner, the tension applying motor 53 drives the tension applying unit 29 and the tension bar 30 applies tension to the printing medium 17.

The second leg part 2*c* is provided with a first sensor 55 and a second sensor 56 via a supporting part that is not illustrated in the drawing. The first sensor 55 and the second sensor 56 can be sensors that use light, magnetism, capacitance and the like. The first sensor 55 and the second sensor 56 detect whether the flag plate 49*a* is present or absent at respective locations where they are provided. The first sensor 55 and the second sensor 56 are also called proximity sensors. In other words, the first sensor 55 and the second sensor 56 are sensors that detect an end of the flag plate 49*a*. Here, the flag plate 49*a* is composed of, for example, a stainless-steel sheet that does not transmit an infrared ray. Hereafter, the first sensor 55 and the second sensor 56 are described as optical sensors. Each of the first sensor 55 and the second sensor 56 is composed of a pair of a light-emitting element and a light reception element. The first sensor 55 and the second sensor 56 are turned "ON" when light emitted from the light-emitting element is received by the light reception element. Conversely, they are turned "OFF" when light is blocked between the light-emitting element and the light reception element. Accordingly, when the flag plate 49*a* is located at the first sensor 55 and the second sensor 56, the light from the light-emitting element is blocked before reaching the light reception element, and the first sensor 55 and the second sensor 56 are turned "OFF". When the second arm part 49 rotates about the second shaft 47*a* as the center of rotation, the end of the flag plate 49*a* reaches the first sensor 55 or the second sensor 56. At this time, the state where the flag plate 49*a* is located at the position of the sensor is switched to a state where the flag plate 49*a* is not located at the position. Thus, the first sensor 55 and the second sensor 56 can detect the end of the flag plate 49*a*.

When the printing apparatus 1 is activated, the control unit 6 drives the tension applying motor 53 to rotate the second arm part 49. Then, the first sensor 55 and the second sensor 56 detect an upper end 49*c* and a lower end 49*d* of the arc-like end portion of the flag plate 49*a* in the rotational direction of thereof. The control unit 6 recognizes the movement range of the second arm part 49 and the tension bar 30. When the upper end 49*c* on the +Z side of the flag plate 49*a* is not at the first sensor 55 whereas the flag plate 49*a* is located at the second sensor 56 (that is, when the first sensor 55 is "ON" and the second sensor 56 is "OFF"), the counter in the tension applying unit encoder 54 is reset. The control unit 6 recognizes the location where the tension bar 30 is moved up. The location of the tension bar 30 at this time is the upper limit position. This state is referred to as "the first sensor 55 detects the upper end 49*c*". Likewise, when the lower end 49*d* on the −Z side of the flag plate 49*a* is not at the second sensor 56 whereas the flag plate 49*a* is located at the first sensor 55 (that is, when the first sensor 55 is "OFF" and the second sensor 56 is "ON"), the control unit 6 recognizes the location where the tension bar 30 is moved down. The location of the tension bar 30 at this time is the lower limit position. This state is referred to as "the second sensor 56 detects the lower end 49*d*". That is, the tension bar 30 moves between the upper limit position and the lower limit position.

Note that the tension applying unit encoder 54 may not be provided on the +X direction side of the tension applying motor 53. For example, a light-transmissive member having a scale of a predetermined resolution may be configured to be attached to the arc portion of the flag plate 49*a*. With this configuration, an occurrence of an error in a position of the tension bar 30 is suppressed even when backlash occurs between the intermediate gear 51 and the driving gear 52, for example.

Figure 5:
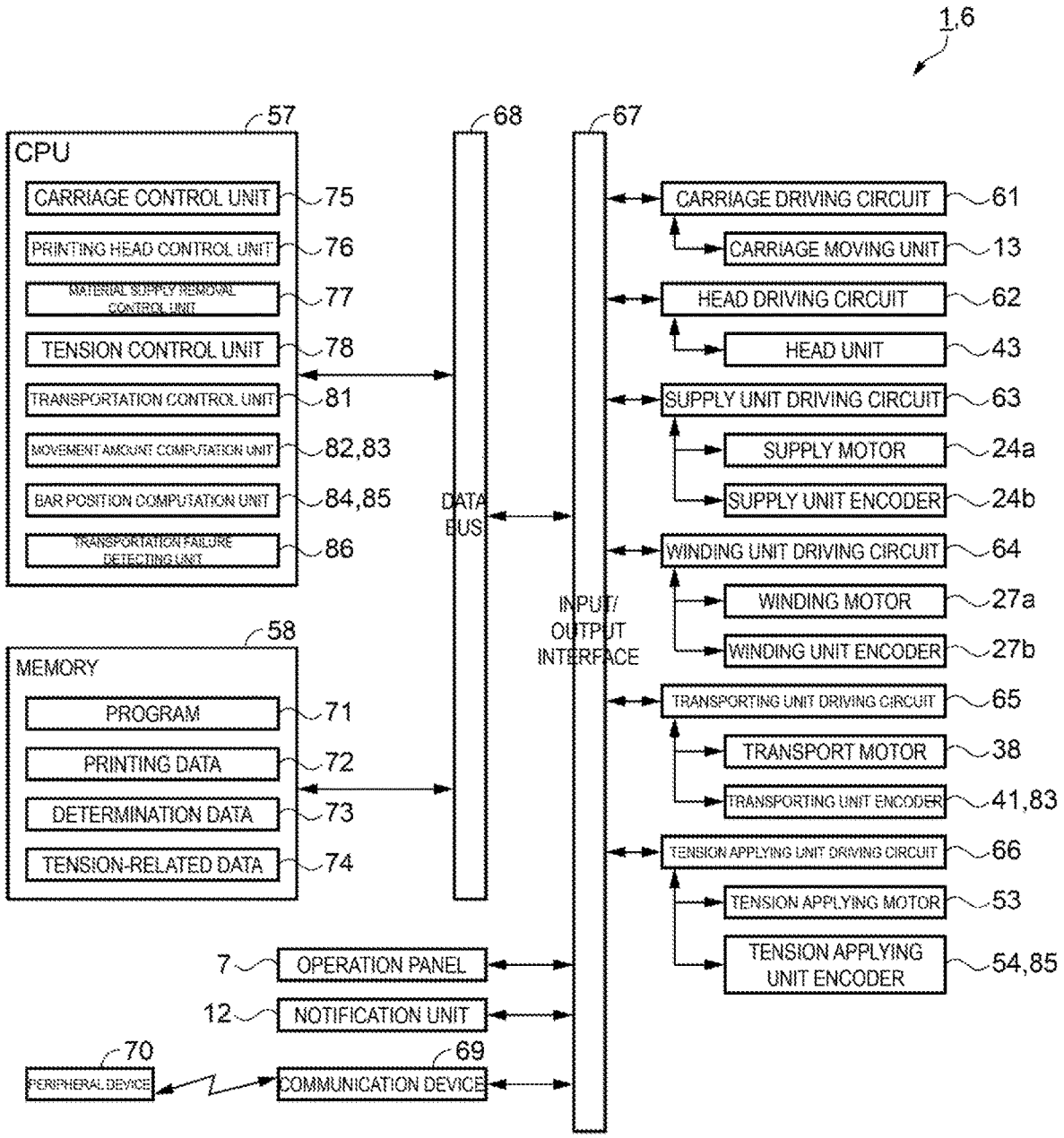
FIG. 5 is an electrical block diagram illustrating a configuration of a control unit.

FIG. 5 is an electrical block diagram illustrating a configuration of a control unit. In FIG. 5, the control unit 6 includes a central processing unit (CPU) 57 that performs various arithmetic processes as a processor, and a memory 58 that stores a variety of information as a storage unit. A carriage driving circuit 61, a head driving circuit 62, a supply unit driving circuit 63, a winding unit driving circuit 64, a transporting unit driving circuit 65 and a tension applying unit driving circuit 66 are connected with the CPU 57 via an input/output interface 67 and a data bus 68. Further, the operation panel 7, the notification unit 12 and a communication device 69 are connected with the CPU 57 via the input/output interface 67 and the data bus 68.

The carriage driving circuit 61 is a circuit that drives the carriage moving unit 13 including the motor 13*a* and the encoder 13*b*. The carriage driving circuit 61 receives an instruction signal of the CPU 57. In accordance with the instruction signal, the carriage driving circuit 61 rotates the motor 13*a* at a predetermined rotational speed and a predetermined rotation angle. The carriage 15 is moved by the rotation of the motor 13*a*.

The carriage driving circuit 61 converts a signal output by the encoder 13*b* into digital data and outputs it to the CPU 57. Since the encoder 13*b* detects the movement amount of the carriage 15, the CPU 57 receives a signal output by the carriage driving circuit 61 and recognizes the position of the carriage 15.

The head driving circuit 62 is a circuit that drives the printing head provided in the head unit 43. The head driving circuit 62 drives the printing head for ejection on the basis of printing data output by the CPU 57 to cause the printing head to eject ink from the nozzle.

The supply unit driving circuit 63 is a circuit that drives the supply motor 24*a* and the supply unit encoder 24*b*. The supply unit driving circuit 63 receives an instruction signal of the CPU 57. In accordance with the instruction signal, the supply unit driving circuit 63 rotates the supply motor 24*a* at a predetermined rotational speed and a predetermined rotation angle. By the rotation of the supply motor 24*a*, the printing medium 17 is supplied from the medium supply unit 23 to the printing unit 5.

The supply unit driving circuit 63 converts a signal output by the supply unit encoder 24*b* into digital data and outputs it to the CPU 57. Since the supply unit encoder 24*b* detects the rotation angle of the supply side roll body 25, the CPU 57 receives a signal output by the supply unit driving circuit 63 and recognizes the length of the printing medium 17 supplied by the supply side roll body 25.

The winding unit driving circuit 64 is a circuit that drives the winding motor 27*a* and the winding unit encoder 27*b*. The winding unit driving circuit 64 receives an instruction signal of the CPU 57. In accordance with the instruction signal, the winding unit driving circuit 64 rotates the winding motor 27*a* at a predetermined rotational speed and a predetermined rotation angle. By the rotation of the winding motor 27*a*, the printing medium 17 is wound from the tension applying unit 29.

The winding unit driving circuit 64 converts a signal output by the winding unit encoder 27*b* into digital data and outputs it to the CPU 57. Since the winding unit encoder 27*b* detects the rotation angle of the winding side roll body 28, the CPU 57 receives the signal output by the winding unit driving circuit 64 and recognizes the length of the printing medium 17 that is wound around the winding side roll body 28.

The transporting unit driving circuit 65 is a circuit that drives the transportation motor 38 and the transporting unit encoder 41. The transporting unit driving circuit 65 receives an instruction signal of the CPU 57. In accordance with the instruction signal, the transporting unit driving circuit 65 rotates the transportation motor 38 at a predetermined rotational speed and a predetermined rotation angle. By the rotation of the transportation motor 38, the printing medium 17 is supplied to the printing unit 5.

The transporting unit driving circuit 65 converts a signal output by the transporting unit encoder 41 into digital data and outputs it to the CPU 57. Since the transporting unit encoder 41 detects the rotation angle of the transportation driving roller 36*a*, the CPU 57 receives the signal output by the transporting unit driving circuit 65 and recognizes the length of the printing medium 17 that is transported by the transportation roller 36.

The tension applying unit driving circuit 66 is a circuit that drives the tension applying motor 53 and the tension applying unit encoder 54. The tension applying unit driving circuit 66 receives an instruction signal of the CPU 57. In accordance with the instruction signal, the tension applying unit driving circuit 66 causes the tension applying motor 53 to output a predetermined torque. From the torque output by the tension applying motor 53, tension is applied to the printing medium 17.

The tension applying unit driving circuit 66 converts a signal output by the tension applying unit encoder 54 into digital data and outputs it to the CPU 57. Since the tension applying unit encoder 54 detects the rotation angle of the second arm part 49 corresponding to the position of the tension bar 30, the CPU 57 receives the signal output by the tension applying unit driving circuit 66 and recognizes the position of the tension bar 30.

The operation panel 7 includes the operation unit 8 and the display unit 9. The operator operates the operation unit 8 to input various printing conditions. Then, the operation panel 7 outputs the input information to the CPU 57. Then, the CPU 57 causes the display unit 9 to display a message to the operator.

The notification unit 12 includes the notification light 10, the speaker 11 and the like. The notification unit 12 notifies the state of the printing apparatus 1 with sound and light to the operator. When an abnormality occurs in the printing apparatus 1, warning sound and strong light are output so that the operator can realize the notification even when the operator is away from the printing apparatus 1.

The communication device 69 is a device that communicates with a peripheral device 70. The communication device 69 receives printing data from the peripheral device 70 by communicating with the peripheral device 70. Further, a printing start signal and various data used in printing are received.

The memory 58 is a concept including semiconductor memories such as a RAM and a ROM, and external storage devices such as a hard disk. The memory 58 stores a program 71 in which an operation control procedure of the printing apparatus 1, a determination procedure of a transportation failure and the like are described. Further, the memory 58 stores printing data 72 that is data for printing of the printing unit 5. Further, the memory 58 stores determination data 73 that is data for the CPU 57 to determine whether the state of the printing apparatus 1 is normal or abnormal. Further, the memory 58 stores tension-related data 74 that is data of the tension to be applied to the printing medium 17. Further, the memory 58 includes various storage areas including a storage area that functions as a temporally file, a work area and the like for the CPU 57.

The CPU 57 controls the operation of the printing apparatus 1 in accordance with the program 71 stored in the memory 58. The CPU 57 includes various functional parts for achieving functions. Specifically, the CPU 57 includes a carriage control unit 75 as a functional part. The carriage control unit 75 performs controls of the movement speed, the movement direction, the movement position and the like of the carriage 15. The carriage control unit 75 outputs, to the carriage driving circuit 61, a parameter for controlling the operation of the carriage 15. The carriage control unit 75 outputs, to the carriage driving circuit 61, an instruction signal of the start and stop of the operation of the carriage 15. In accordance with the instruction signal output by the carriage control unit 75, the carriage driving circuit 61 causes the carriage moving unit 13 to move the carriage 15.

Further, the CPU 57 includes a printing head control unit 76. The printing head control unit 76 controls the ejection of the ink ejected from a plurality of printing heads provided in the head unit 43. The printing head control unit 76 outputs, to the head driving circuit 62, data of ejecting timing of each printing head. The head driving circuit 62 drives the printing head in accordance with the data of the ejecting timing. The printing head control unit 76 performs the control of the ejecting timing by using the location information of the carriage 15 input by the carriage control unit 75.

Further, the CPU 57 includes a material supply removal control unit 77. The material supply removal control unit 77 outputs, to the supply unit driving circuit 63, an instruction signal of the rotational speed, the rotation start, the rotation stop and the like of the supply motor 24*a*. The material supply removal control unit 77 increases the rotational speed of the supply motor 24*a* as the diameter of the supply side roll body 25 decreases. The material supply removal control unit 77 controls the speed of the printing medium 17 supplied to the printing unit 5 by the medium supply unit 23 at a constant speed.

The material supply removal control unit 77 outputs, to the winding unit driving circuit 64, an instruction signal of the rotational speed of the winding motor 27*a*. The material supply removal control unit 77 receives data of the rotation angle of the second arm part 49 output by the tension applying unit encoder 54. With reference to the data of the rotation angle, the material supply removal control unit 77 outputs, to the winding unit driving circuit 64, an instruction signal of the rotation start, the rotation stop and the like of the winding motor 27*a*.

The range of the location where the tension bar 30 can apply tension to the printing medium 17 is limited. This range is referred to as a tension applying possible range. When the tension bar 30 is within the tension applying possible range, the printing medium 17 passes through a location where the tension bar 30 can press the printing medium 17. With an instruction signal of the material supply removal control unit 77, the winding amount of the printing medium 17 wound by the medium winding unit 26 is controlled such that the printing medium 17 passes through the location where the tension bar 30 can press the printing medium 17. When the amount of the printing medium 17 that is wound by the medium winding unit 26 is small, the printing medium 17 slackens, and consequently the tension bar 30 cannot press the printing medium 17. When the medium winding unit 26 winds the printing medium 17 such that the printing medium 17 is not slackened, the tension bar 30 can press the printing medium 17. Further, the tension bar 30 can be moved in accordance with the movement of the printing medium 17.

Further, the CPU 57 includes a tension control unit 78. The tension control unit 78 outputs an instruction signal of a torque of the tension applying motor 53 to the tension applying unit driving circuit 66. By changing the torque of the tension applying motor 53, the tension applied to the printing medium 17 by the tension applying unit 29 is changed. Thus, the tension control unit 78 controls the tension applied to the printing medium 17 via the tension applying unit driving circuit 66, the tension applying motor 53, the first arm part 48, the second arm part 49 and the tension bar 30.

Further, the CPU 57 includes a transportation control unit 81. The transportation control unit 81 outputs an instruction signal of the rotational speed, the rotation start, the rotation stop and the like of the transportation motor 38 to the transporting unit driving circuit 65. The transportation control unit 81 receives the output of the transporting unit encoder 41 via the transporting unit driving circuit 65. The transporting unit encoder 41 outputs data corresponding to the movement amount of the printing medium 17. The transportation control unit 81 recognizes the movement amount of the printing medium 17 and controls the movement speed of the printing medium 17 at a predetermined speed.

Further, the CPU 57 includes a movement amount computation unit 82. The movement amount computation unit 82 receives data of the rotation angle of the rotation shaft of the transportation motor 38 that is output by the transporting unit encoder 41. The movement amount computation unit 82 multiplies the rotation angle of the rotation shaft of the transportation motor 38 with a predetermined coefficient to compute the movement amount of the printing medium 17. A first detecting unit 83 is composed of the transporting unit encoder 41, the movement amount computation unit 82 and the like. The first detecting unit 83 detects the movement amount of the printing medium 17 and outputs movement amount information indicating the movement amount of the printing medium 17 to a transportation failure detecting unit 86.

Further, the CPU 57 includes a bar position computation unit 84. The bar position computation unit 84 receives data of the rotation angle of the rotation shaft of the tension applying motor 53 that is output by the tension applying unit encoder 54. The rotation angle of the rotation shaft of the tension applying motor 53 is multiplied by a predetermined coefficient to compute the rotation angle of the tension bar 30. Since the tension bar 30 rotates around the second shaft 47*a* as the center of rotation, the bar position computation unit 84 can calculate the position of the tension bar 30. A second detecting unit 85 is composed of the tension applying unit encoder 54, the bar position computation unit 84 and the like. The second detecting unit 85 detects the position of the tension bar 30 and outputs, to the transportation failure detecting unit 86, the rod member location information indicating the position of the tension bar 30.

Further, the CPU 57 includes the transportation failure detecting unit 86. The transportation failure detecting unit 86 receives the movement amount of the printing medium 17 that is detected by the transporting unit encoder 41. Further, the transportation failure detecting unit 86 receives data indicating the position of the tension bar 30 that is output by the tension applying unit encoder 54. When the tension bar 30 is not moving while the printing medium 17 is moving, it is determined that a transportation failure of the printing medium 17 is caused, and thus the transportation failure of the printing medium 17 is detected. In this manner, when the printing medium 17 is transported at the transporting unit 39, the transportation failure detecting unit 86 in the control unit 6 determines the movement state of the printing medium 17 at the tension applying unit 29 on the basis of the movement amount information and the rod member location information.

When the printing medium 17 adheres to the guide member 34, the printing medium 17 does not move at the tension applying unit 29. At this time, the transportation failure detecting unit 86 determines that the printing medium 17 is not moving at the tension applying unit 29 and the printing medium 17 is moving at the transporting unit 39. As a result, the printing apparatus 1 can detect the transportation failure of the printing medium 17.

Further, the CPU 57 includes a functional part that is not illustrated. For example, the CPU 57 performs a control of displaying the state of the apparatus and displaying information relating to measurement on the display unit 9. Further, the CPU 57 performs a control of driving the notification unit 12 when an abnormality is caused in the printing apparatus 1.

Figure 6:
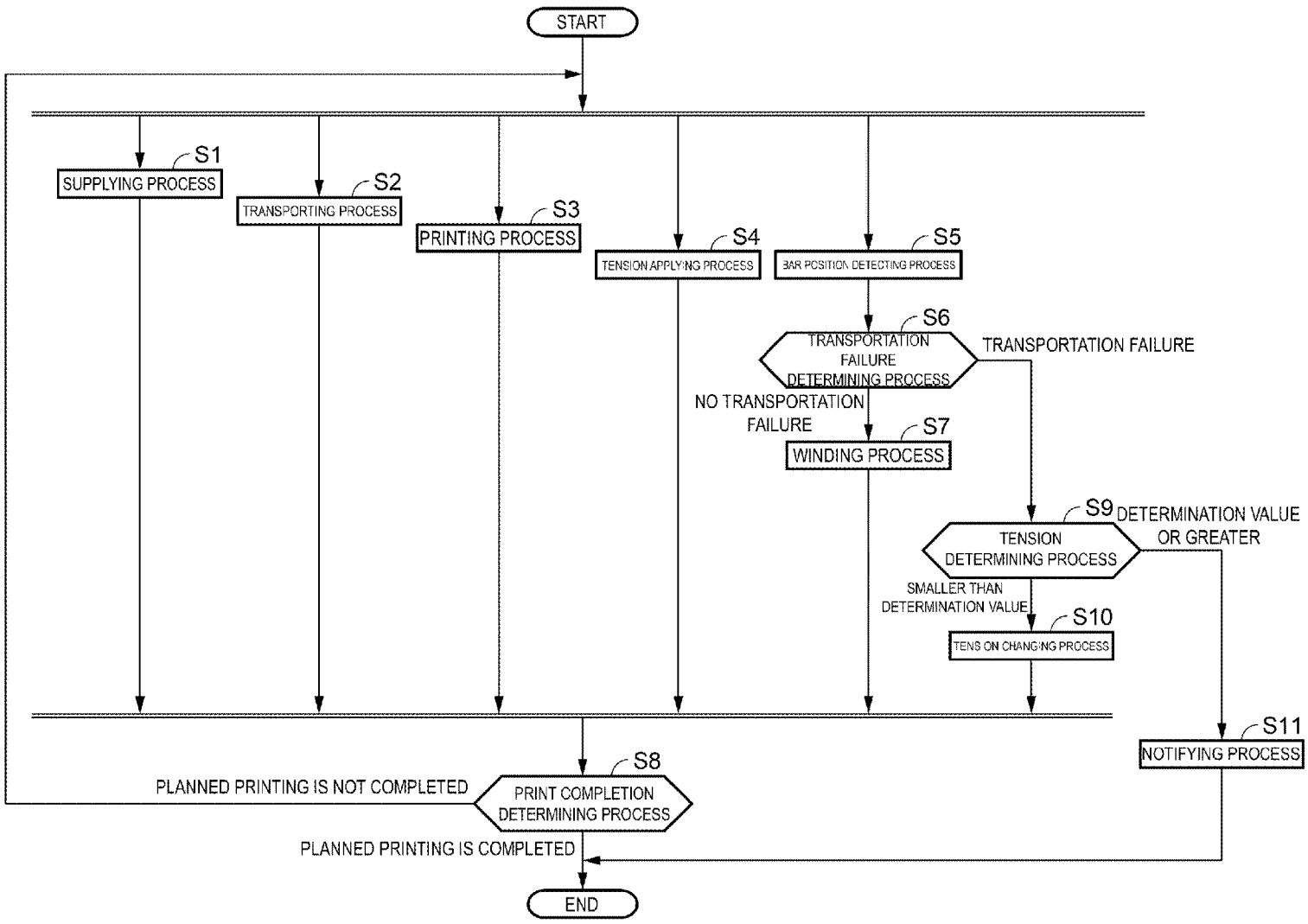
FIG. 6 is a flowchart of a printing method.

Next, the printing method performed by the printing apparatus 1 is described with reference to FIG. 6 to FIG. 22. FIG. 6 is a flowchart of the printing method. In the flowchart of FIG. 6, step S1 to step S4 are performed in parallel. Further, step S5 to step S7 and step S9 to step S10 are performed in parallel with step S1 to step S4.

Step S1 is a supplying process. In this process, the medium supply unit 23 supplies the printing medium 17 to the guide member 34. Next, the process proceeds to step S8. Step S8 is a print completion determining process. This process is a process determining whether the planned printing is completed. When the planned printing is not completed, the process proceeds to step S1 to step S5. When the planned printing is completed, the printing process is terminated.

Step S2 is a transporting process. In this process, the transporting unit 39 transports the printing medium 17 along the guide member 34. Then, in this process, the first detecting unit 83 detects the movement amount of the printing medium 17 and outputs movement amount information indicating the movement amount of the printing medium 17 to the transportation failure detecting unit 86. Next, the process proceeds to step S8. Step S3 is a printing process. In this process, the printing unit 5 performs printing on the printing medium 17. Next, the process proceeds to step S8. Step S4 is a tension applying process. In this process, the tension bar 30 applies tension to the printing medium 17 by pressing the printing medium 17 while moving between the upper limit position and the lower limit position at a location between the transporting unit 39 and the medium winding unit 26. Next, the process proceeds to step S8.

Step S5 is a bar position detecting process. In this process, the second detecting unit 85 detects the position of the tension bar 30 and outputs rod member location information indicating the position of the tension bar 30 to the transportation failure detecting unit 86. Next, the process proceeds to step S6. Step S6 is a transportation failure determining process. In this process, the transportation failure detecting unit 86 of the control unit 6 determines the slackness of the printing medium 17 on the basis of the movement amount information and the rod member location information. The transportation failure detecting unit 86 determines the transportation state on the basis of the slackness of the printing medium 17. When the printing medium 17 is slack, it is determined that a transportation failure occurs. When there is no transportation failure, the process proceeds to step S7. When there is a transportation failure, the process proceeds to step S9.

Step S7 is a winding process. In this process, at a location further downstream of the guide member 34 than the transporting unit 39, the medium winding unit 26 winds the printing medium 17. Next, the process proceeds to step S8. Step S9 is a tension determining process. In this process, the intensity of the tension applied to the printing medium 17 by the tension bar 30 is determined. When the intensity of the tension is smaller than a determination value, the process proceeds to step S10. The determination value is defined as a threshold value regarding the movement amount of the rod member when the printing medium 17 is transported. For example, the determination value is determined based on an experiment. When the intensity of the tension is equal to or greater than the determination value, the process proceeds to step S11.

Step S10 is a tension changing process. In this process, the intensity of the tension applied to the printing medium 17 by the tension bar 30 is increased. When the transportation failure detecting unit 86 detects a transportation failure of the printing medium 17 in the control unit 6, the tension control unit 78 controls the tension applying motor 53 to cause the force applied by the tension applying unit 29 to press the printing medium 17 to be greater than the force at the time when the transportation failure of the printing medium 17 has been detected. Next, the process proceeds to step S8. Step S11 is a notifying process. In this process, the CPU 57 drives the notification unit 12 to notify the operator of an abnormality state of the printing apparatus 1. After the notifying step is terminated, the printing process is terminated. Through the above-mentioned processes, the processes in which the printing unit 5 performs printing on the printing medium 17 is completed.

FIG. 7 to FIG. 22 are drawings or schematic views for describing the printing method. Next, with reference to FIG. 7 to FIG. 22, the printing method will be described in detail in correspondence with the steps illustrated in FIG. 6.

Figure 7:
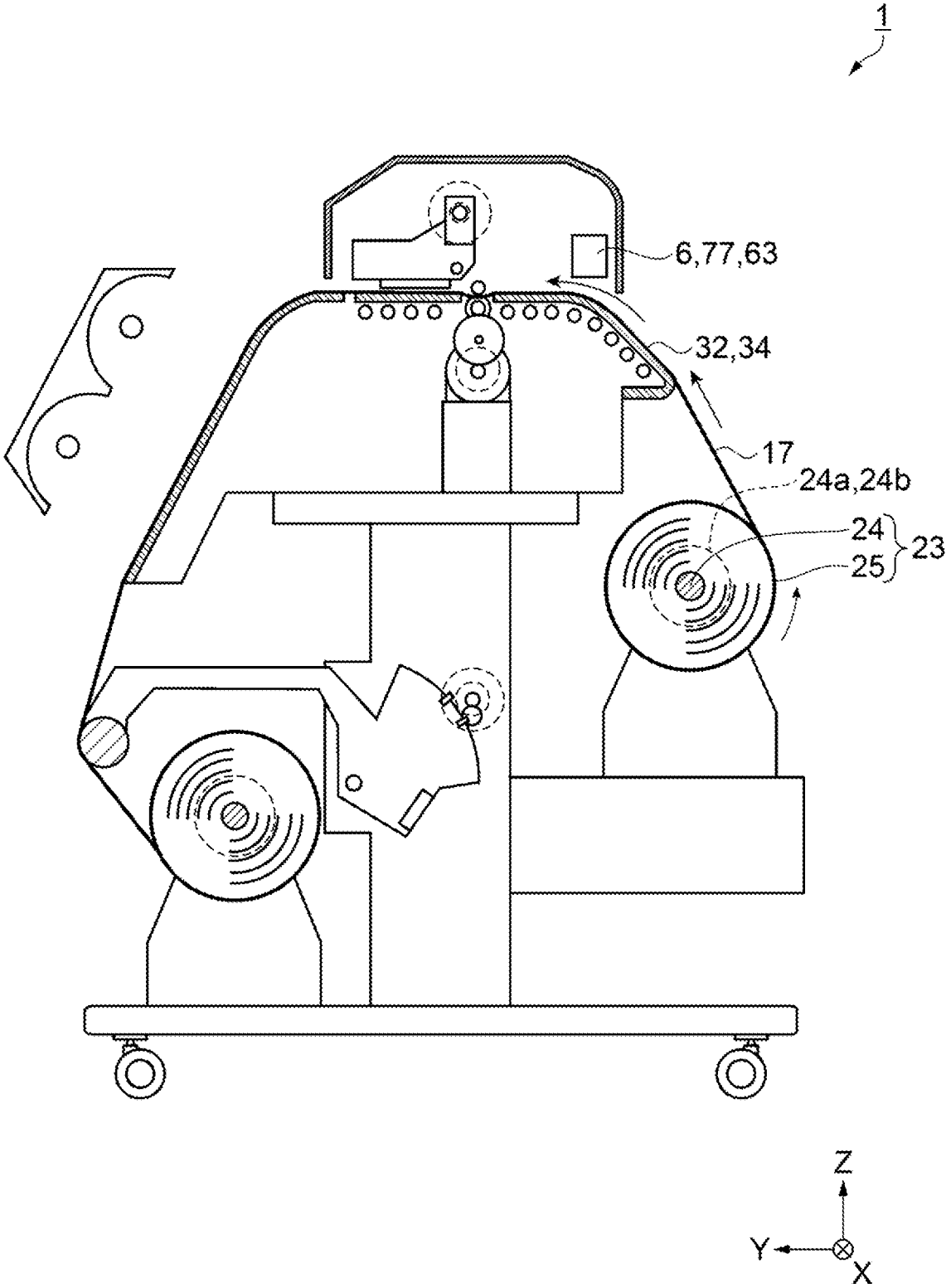
FIG. 7 is a schematic view for describing the printing method.

FIG. 7 corresponds to the supplying process of step S1. As illustrated in FIG. 7, the material supply removal control unit 77 causes the supply unit driving circuit 63 to drive the supply motor 24*a*. When the supply motor 24*a* rotates, the printing medium 17 is supplied to the guide member 34. The supply unit encoder 24*b* detects the rotation angle of the supply shaft 24 and outputs it to the supply unit driving circuit 63. The supply unit driving circuit 63 controls the rotation angle of the supply shaft 24 in accordance with the variation of the diameter of the supply side roll body 25. Then, the printing medium 17 is supplied from the supply side roll body 25 at a predetermined supply speed.

Figure 8:
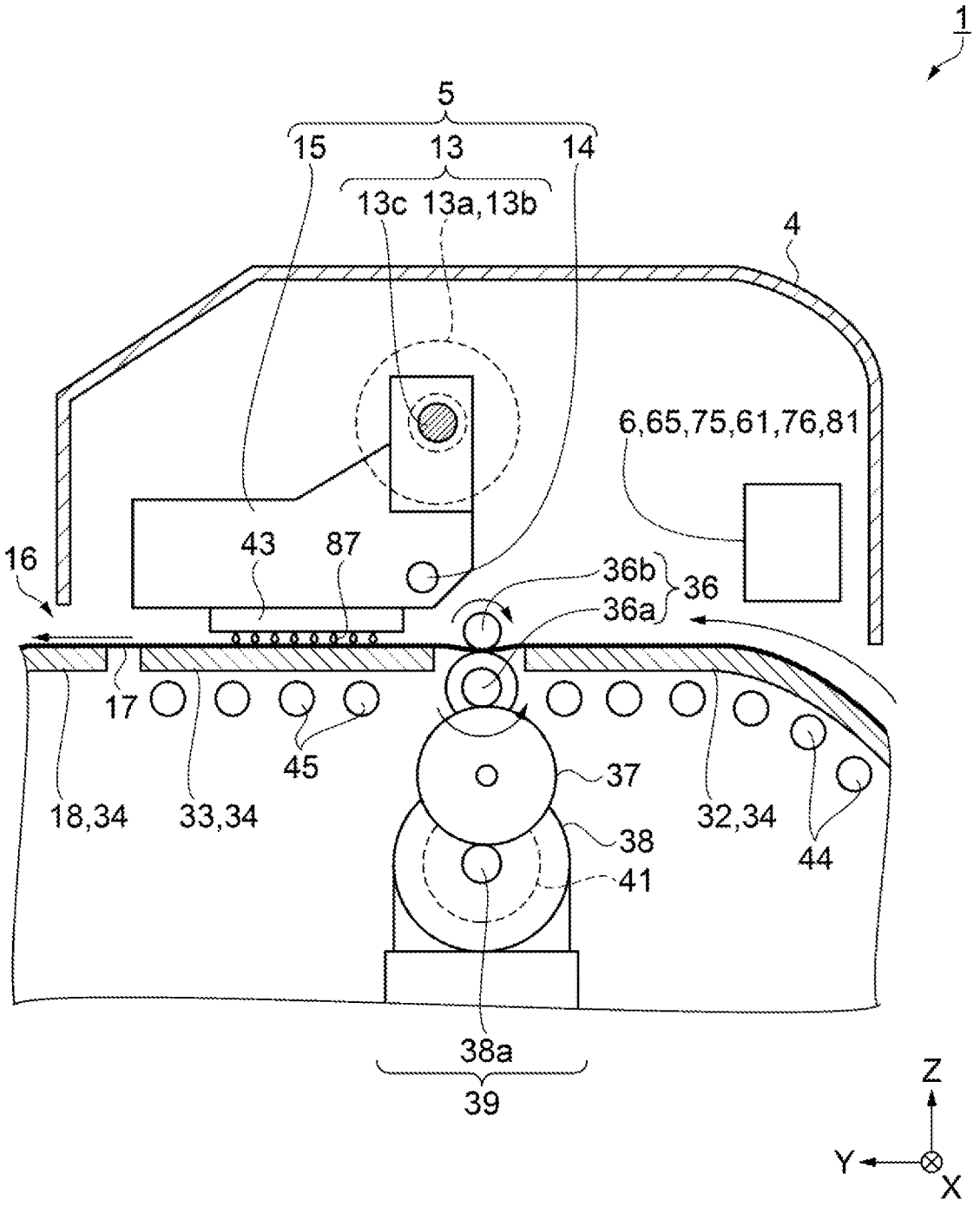
FIG. 8 is a schematic view for describing the printing method.

FIG. 8 corresponds to the transporting process of step S2 and the printing process of step S3. As illustrated in FIG. 8, at step S2, the transportation control unit 81 causes the transporting unit driving circuit 65 to drive the transportation motor 38. When the transportation motor 38 rotates, the printing medium 17 is transported along the guide member 34. The transporting unit encoder 41 detects the rotation angle of the transportation driving roller 36*a* and outputs it to the transporting unit driving circuit 65. Receiving the data of the rotation angle of the transportation driving roller 36*a*, the transporting unit driving circuit 65 controls the transportation amount of the printing medium 17 transported by the transportation roller 36.

At step S3, the carriage control unit 75 causes the carriage driving circuit 61 to drive the motor 13*a*. When the motor 13*a* rotates, the carriage 15 moves along the guide rail 14. The encoder 13*b* detects the rotation angle of the motor 13*a* and outputs it to the carriage driving circuit 61. Receiving data of the rotation angle of the motor 13*a*, the carriage driving circuit 61 controls the carrying speed of the carriage 15.

In parallel with transportation of the printing medium 17 and movement of the carriage 15, ink 87 is ejected from the nozzle of the printing head in the head unit 43. The printing head control unit 76 receives the printing data 72 from the memory 58. Then, when the nozzle is located at a location opposite the location where the ink 87 is planned to be placed, the ink 87 is ejected from the nozzle. The carriage control unit 75, the transportation control unit 81 and the printing head control unit 76 perform drawing on the printing medium 17 in cooperation with each other. Since the printing medium 17 has been heated by the first heater 44 and the second heater 45, the ink 87 is easily dried. Further, since the infrared ray heater 21 dries the ink 87, the ink 87 is dried before the printing medium 17 reaches the medium winding unit 26.

Figure 9:
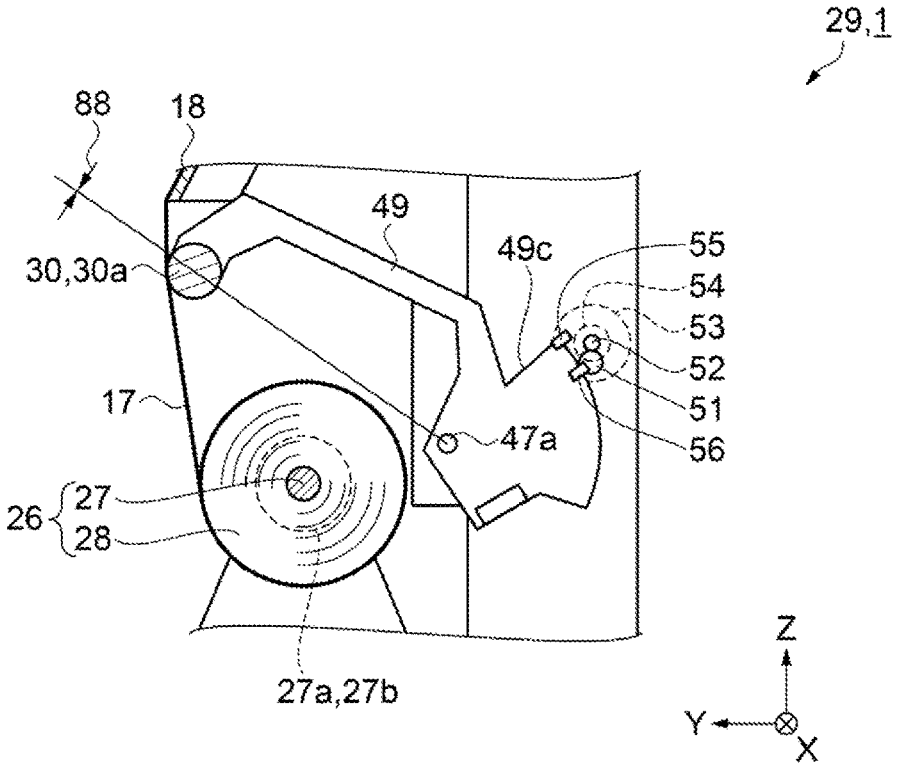
FIG. 9 is a schematic view for describing the printing method.

FIG. 9 to FIG. 14 correspond to the tension applying process of step S4, the bar position detecting process of step S5 and the winding process of step S7. Step S4 and step S5 are performed in parallel. As illustrated in FIG. 9, at step S4, the tension bar 30 is located at an upper limit position 30*a* in the state where the printing medium 17 is wound around the medium winding unit 26. At this time, the first sensor 55 detects the upper end 49*c*.

The tension bar 30 rotates around the second shaft 47*a*. The rotation angle of the tension bar 30 is set as a tension bar angle 88 as the movement amount of the rod member. The tension bar angle 88 is set to 0 degree when the tension bar 30 is located at the upper limit position 30*a*. The tension control unit 78 causes the tension applying unit driving circuit 66 to drive the tension applying motor 53. The tension applying motor 53 is a direct-current motor. Since the torque of the tension applying motor 53 is proportional to the current, the tension applying unit driving circuit 66 can readily control the torque of the tension applying motor 53 by controlling the current flowing through the tension applying motor 53.

The tension applying unit driving circuit 66 outputs, to the bar position computation unit 84, the rotation angle of the driving gear 52 that is detected by the tension applying unit encoder 54. The bar position computation unit 84 multiplies the rotation angle of the driving gear 52 with a predetermined coefficient to calculate the tension bar angle 88. Since the distance between the second shaft 47*a* and the tension bar 30 is constant, the tension bar angle 88 corresponds to the position of the tension bar 30.

Figure 10:
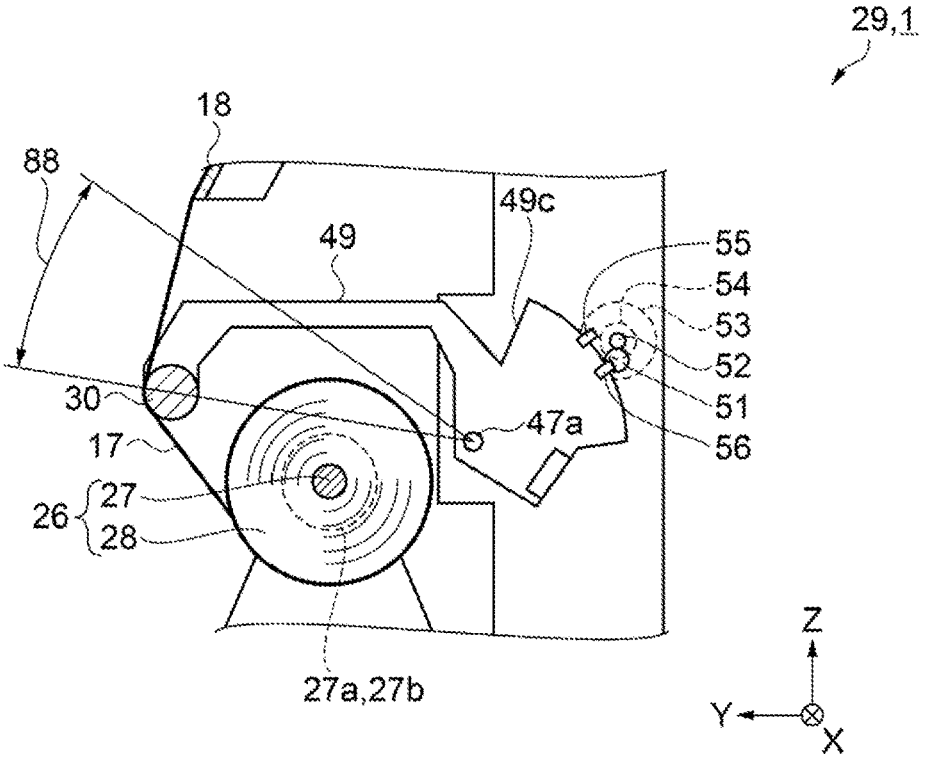
FIG. 10 is a schematic view for describing the printing method.

As illustrated in FIG. 10, in the medium winding unit 26, the transporting unit 39 transports the printing medium 17 while the winding motor 27*a* does not rotate the winding side roll body 28. At this time, the length of the printing medium 17 located between the downstream side guide part 18 and the medium winding unit 26 increases. Then, since the tension bar 30 is rotated at a constant torque by the tension applying motor 53, the tension bar 30 is moved down in the −Z direction. Constant tension acts on the printing medium 17 by the tension bar 30. The tension bar 30 rotates about the second shaft 47*a*, and thus the tension bar angle 88 increases.

Figure 11:
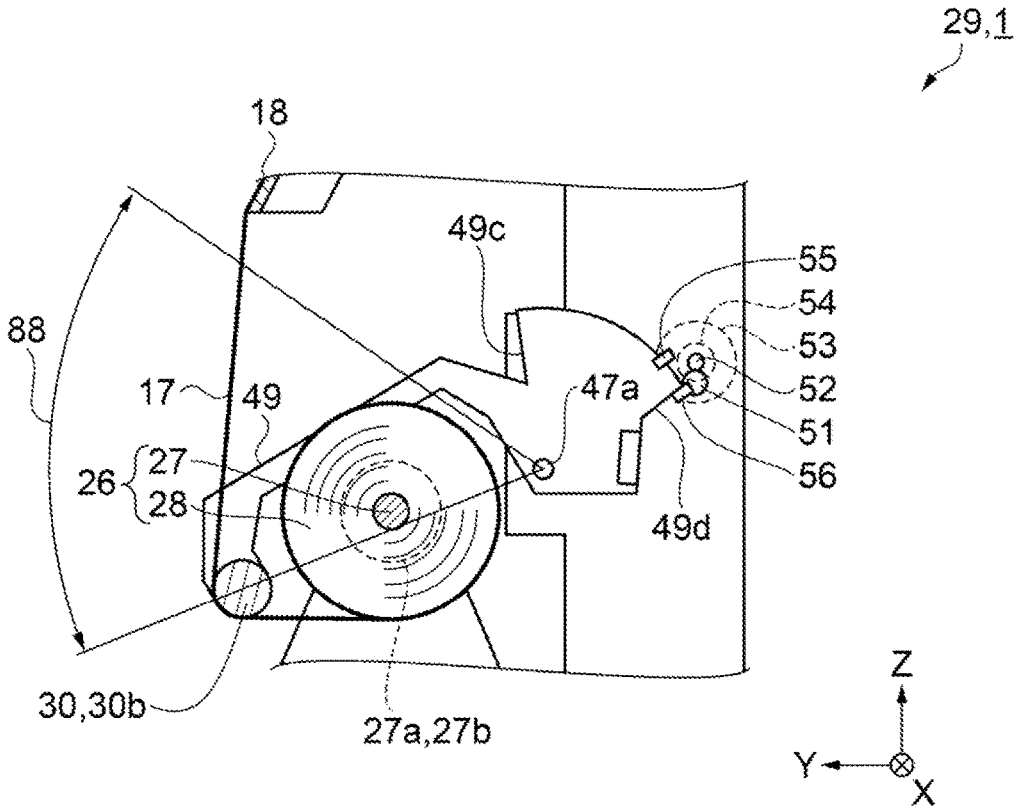
FIG. 11 is a schematic view for describing the printing method.

As illustrated in FIG. 11, when the tension bar 30 is moved down, the lower end 49*d* of the second arm part 49 rotates about the second shaft 47*a* and the second sensor 56 detects the lower end 49*d*. The position of the tension bar 30 at this time is a lower limit position 30*b*. In this manner, in the tension applying unit 29, the tension bar 30 presses the printing medium 17 between the transporting unit 39 and the medium winding unit 26, and applies tension to the printing medium 17 while moving between the upper limit position 30*a* and the lower limit position 30*b*. The tension bar angle 88 is maximized at the lower limit position 30*b*.

Figure 12:
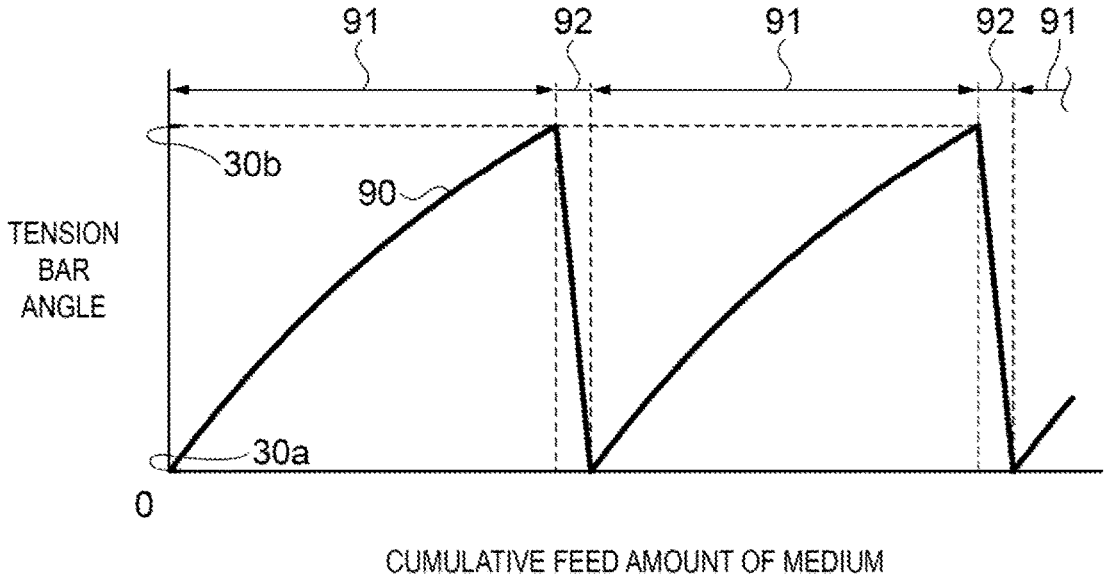
FIG. 12 is a drawing for describing the printing method.

FIG. 12 illustrates a relationship between the feed amount of the printing medium 17 and the tension bar angle 88. In FIG. 12, a vertical axis indicates the tension bar angle 88, and the angle is greater on the upper side of the vertical axis than on the lower side. The tension bar angle 88 varies between the upper limit position 30*a* and the lower limit position 30*b* of the tension bar 30. A horizontal axis indicates a cumulative feed amount of the medium, which corresponds to the amount of the printing medium 17 fed by the transporting unit 39. In the drawing, the cumulative feed amount of the medium is larger on the right side of the horizontal axis than on the left side. The cumulative feed amount of the medium increases with time passing. An angle transition line 90 indicates variation of the tension bar angle 88.

In the horizontal axis, the winding side roll body 28 is stopped in a winding stop region 91, whereas the winding side roll body 28 winds the printing medium 17 in a winding operation region 92. The winding stop region 91 and the winding operation region 92 are performed alternately. The proportion of the winding stop region 91 is larger than the proportion of the winding operation region 92. For example, every time when the printing medium 17 is transported multiple times (two times or greater) by the transporting unit 39, the winding side roll body 28 is rotated. As the angle transition line 90 indicates, the tension bar angle 88 increases in the winding stop region 91.

That is, the tension bar 30 moves down. In the winding operation region 92, the tension bar angle 88 decreases more quickly than in the winding stop region 91. That is, the tension bar 30 moves up. In this manner, the tension bar 30 applies tension to the printing medium 17 while the tension bar 30 moves.

Figure 13:
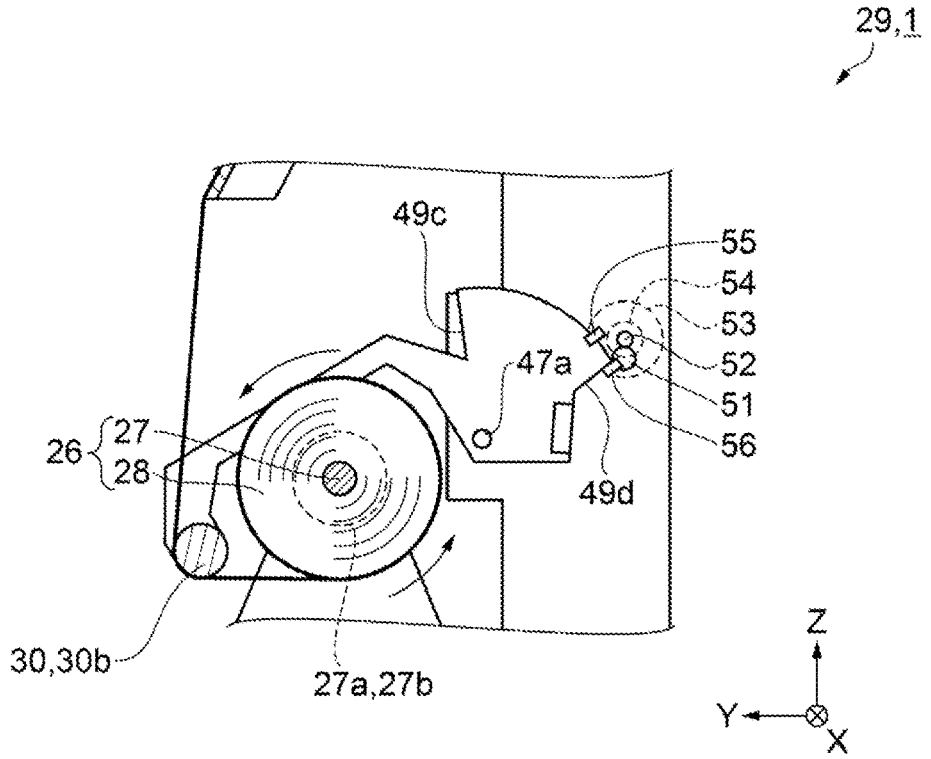
FIG. 13 is a schematic view for describing the printing method.

FIG. 13 illustrates a state where the tension bar 30 has reached the lower limit position 30*b*. The bar position computation unit 84 outputs the tension bar angle 88 to the material supply removal control unit 77 by using the output of the tension applying unit encoder 54. When the tension bar 30 reaches lower limit position 30*b*, the material supply removal control unit 77 causes the winding side roll body 28 to rotate at step S7 to wind the printing medium 17.

Figure 14:
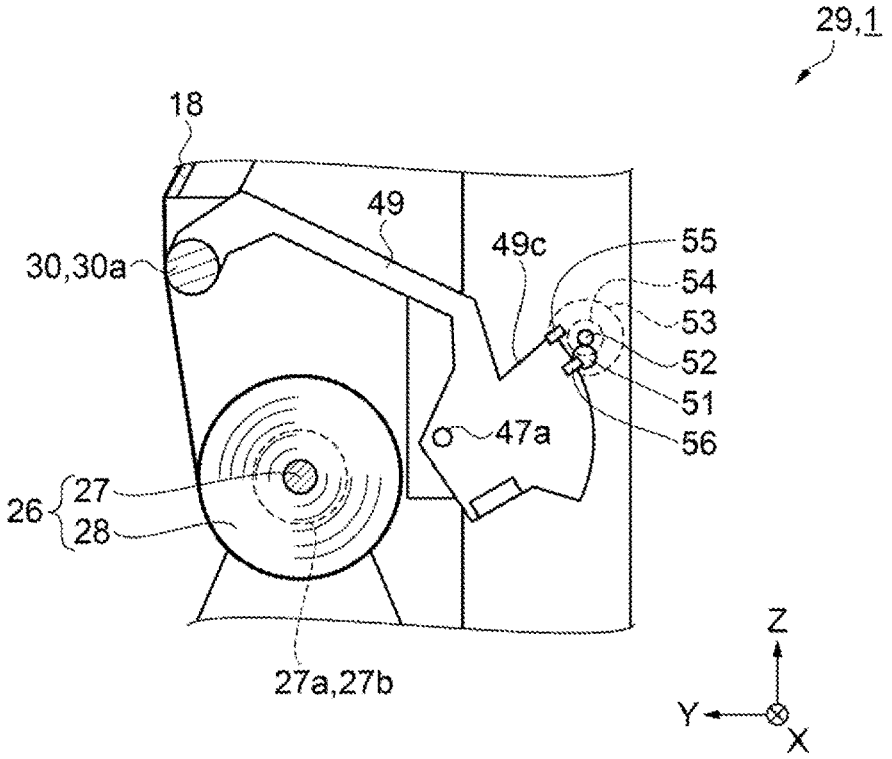
FIG. 14 is a schematic view for describing the printing method.

FIG. 14 illustrates a state where the tension bar 30 reaches the upper limit position 30*a*. The tension bar 30 is moved up by winding the printing medium 17 by rotating the winding side roll body 28. Also at this time, the bar position computation unit 84 outputs the tension bar angle 88 to the material supply removal control unit 77 by using the output of the tension applying unit encoder 54. When the tension bar 30 reaches the upper limit position 30*a*, the material supply removal control unit 77 stops the rotation of the winding side roll body 28 to stop the winding of the printing medium 17.

Figure 15:
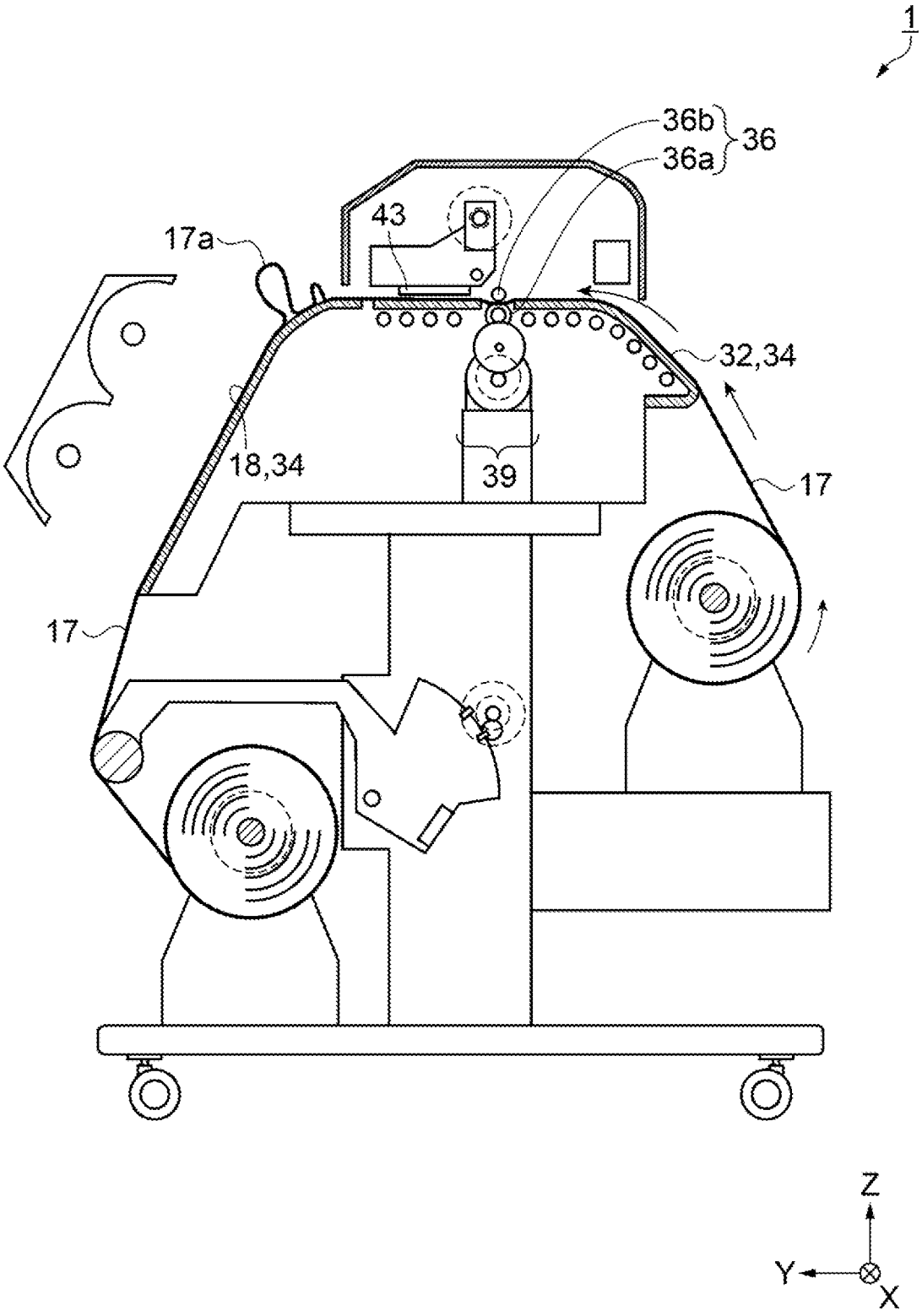
FIG. 15 is a schematic view for describing the printing method.

FIG. 15 to FIG. 22 correspond to the transportation failure determining process of step S6, the tension determining step of step S9, the tension changing process of step S10 and the notifying process of step S11. As illustrated in FIG. 15, when static electricity acts on the printing medium 17 and the printing medium 17 adheres to the downstream side guide part 18, the transporting unit 39 transports the printing medium 17 and consequently a protrusion 17*a*, which results from buckling of the printing medium 17 in a protruding shape, is formed. The location where the protrusion 17*a* is formed is indefinite. When the protrusion 17*a* contacts with the head unit 43, the protrusion 17*a* is stained with the ink 87. In addition, the printing medium 17 is wrinkled and creased, which results in printing failure.

Figure 16:
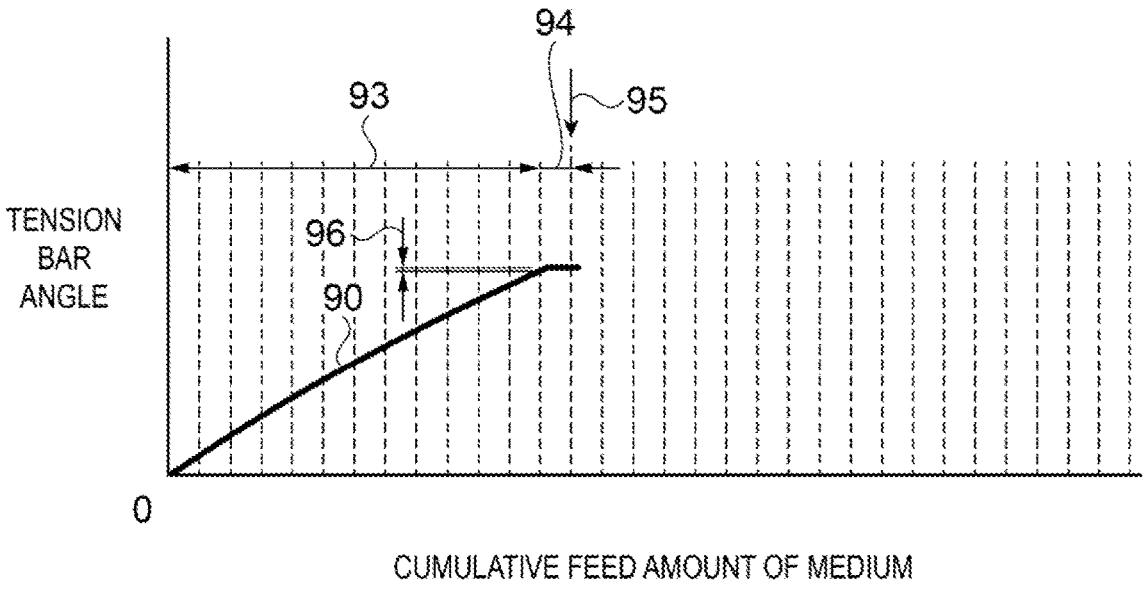
FIG. 16 is a drawing for describing the printing method.

When static electricity acts on the printing medium 17 and the printing medium 17 adheres to the downstream side guide part 18, the printing medium 17 does not advance toward the medium winding unit 26 from the guide member 34. In FIG. 16, the vertical axis and the horizontal axis are identical to those of FIG. 12. In the drawing, the interval between each vertical broken line indicates a cycle of one rotation of the transportation driving roller 36*a*. The transportation failure detecting unit 86 determines the presence or absence of a transportation failure for each rotation of the transportation driving roller 36*a*. That is, the transportation failure detecting unit 86 performs the determination at the timing indicated with the broken lines.

In a normal region 93 in the drawing, the printing medium 17 is normally transported. In an abnormality region 94, a part of the printing medium 17 is adhered to the guide member 34. At this time, the tension bar angle 88 increases in the normal region 93. Meanwhile, the tension bar angle 88 does not change in the abnormality region 94. The transportation failure detecting unit 86 determines the presence or absence of a transportation failure at a determination timing 95 of the abnormality region 94. The transportation failure detecting unit 86 detects the tension bar angle 88 every time when the transporting unit 39 transports the printing medium 17 by a predetermined length, and, when the tension bar angle 88 is smaller than a determination value 96, the transportation failure detecting unit 86 detects a transportation failure of the printing medium 17.

In this manner, the transportation failure detecting unit 86 determines a transportation failure of the printing medium 17 by using only the tension bar angle 88 without computing the movement amount of the printing medium 17 (the length of the track of the tension bar 30) on the basis of the product of the tension bar angle 88 and the distance of the tension bar 30 from the first shaft 46*a* (the second shaft 47*a*). Thus, the transportation failure detecting unit 86 can save the time required for computing the movement amount of the printing medium 17, and therefore can detect a transportation failure in a short time.

Figure 17:
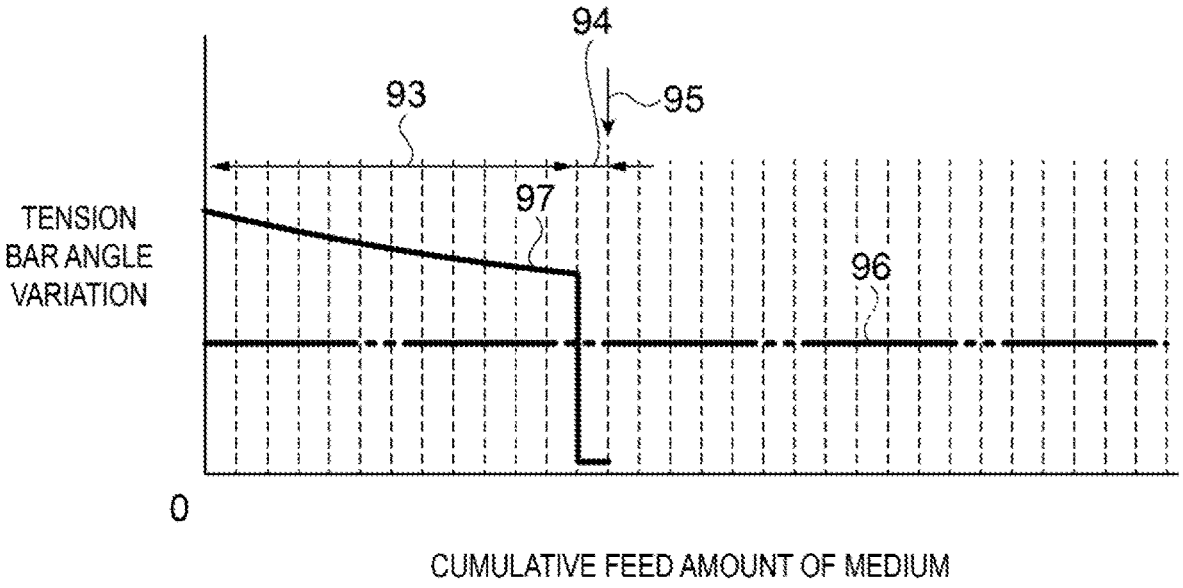
FIG. 17 is a drawing for describing the printing method.

FIG. 17 illustrates a relationship between the cumulative feed amount of the printing medium 17 and the variation of the tension bar angle 88. In FIG. 17, the vertical axis indicates variation of the tension bar angle 88, and the variation is larger on the upper side of the vertical axis than on the lower side. The vertical axis indicates the difference of the variation of the tension bar angle 88 for each rotation of the transportation driving roller 36*a*. The horizontal axis is identical to that of FIG. 12.

An angle variation transition line 97 indicates a change of the variation of the tension bar angle 88. In the normal region 93, the angle variation transition line 97 gradually declines. In the abnormality region 94, the angle variation transition line 97 abruptly declines since the printing medium 17 does not move. Then, the angle variation transition line 97 falls below the determination value 96. Since the angle variation transition line 97 is smaller than the determination value 96 in the determination timing 95, the transportation failure detecting unit 86 determines that a transportation failure is caused.

Figure 18:
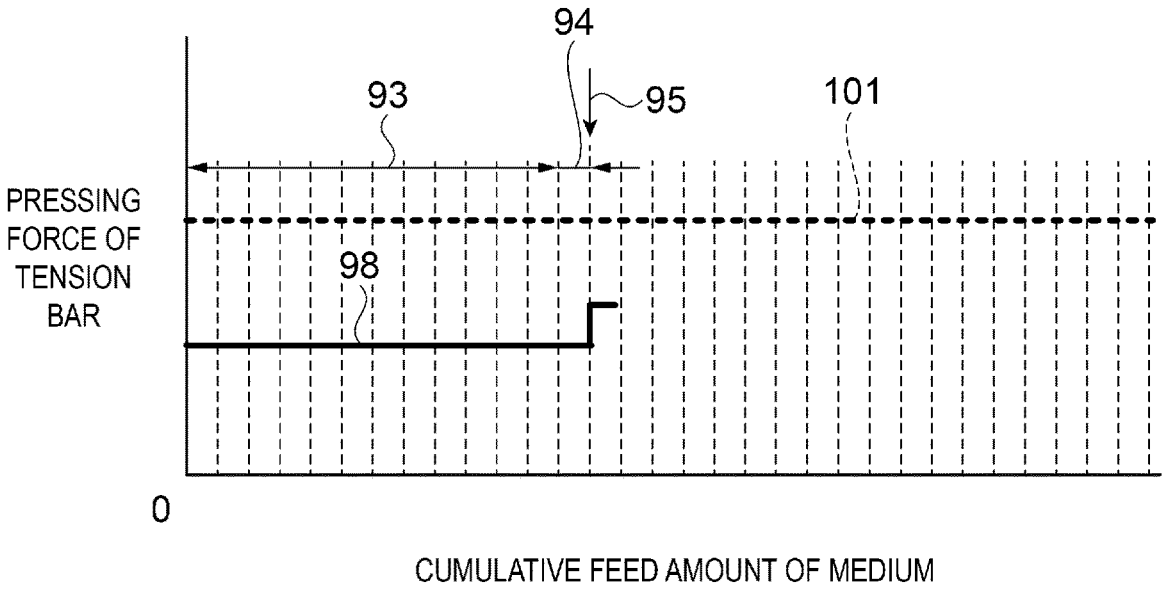
FIG. 18 is a drawing for describing the printing method.

FIG. 18 illustrates a relationship between the feed amount of the printing medium 17 and the force applied by the tension bar 30 to press the printing medium 17. In FIG. 18, the vertical axis indicates a tension bar pressing force, which is the force applied by the tension bar 30 to press the printing medium 17, and corresponds to a torque applied by the tension applying motor 53. Tension is applied to the printing medium 17 in accordance with the tension bar pressing force. In the drawing, the pressing force is greater on the upper side than on the lower side. The horizontal axis is identical to that of FIG. 12. A pressing force transition line 98 remains constant in the normal region 93. When it is determined that a transportation failure is caused at the determination timing 95 at step S6, the pressing force transition line 98 is compared with a pressing force determination value 101 at step S9. The pressing force determination value 101 is a threshold for determinating the abnormality of the tension bar pressing force. That is, it is determined that abnormality is caused when the tension bar pressing force is greater than the pressing force determination value 101.

When the pressing force transition line 98 is smaller than the pressing force determination value 101, the tension applying unit driving circuit 66 increases the current flowing through the tension applying motor 53 by an instruction signal of the tension control unit 78. As a result, the pressing force applied by the tension bar 30 on the printing medium 17 increases. In this manner, when the transportation failure detecting unit 86 detects a transportation failure of the printing medium 17, the tension control unit 78 controls the tension applying motor 53 to cause the force applied by the tension applying unit 29 to press the printing medium 17 to be greater than the force at the time when the transportation failure of the printing medium 17 has been detected.

Figure 19:
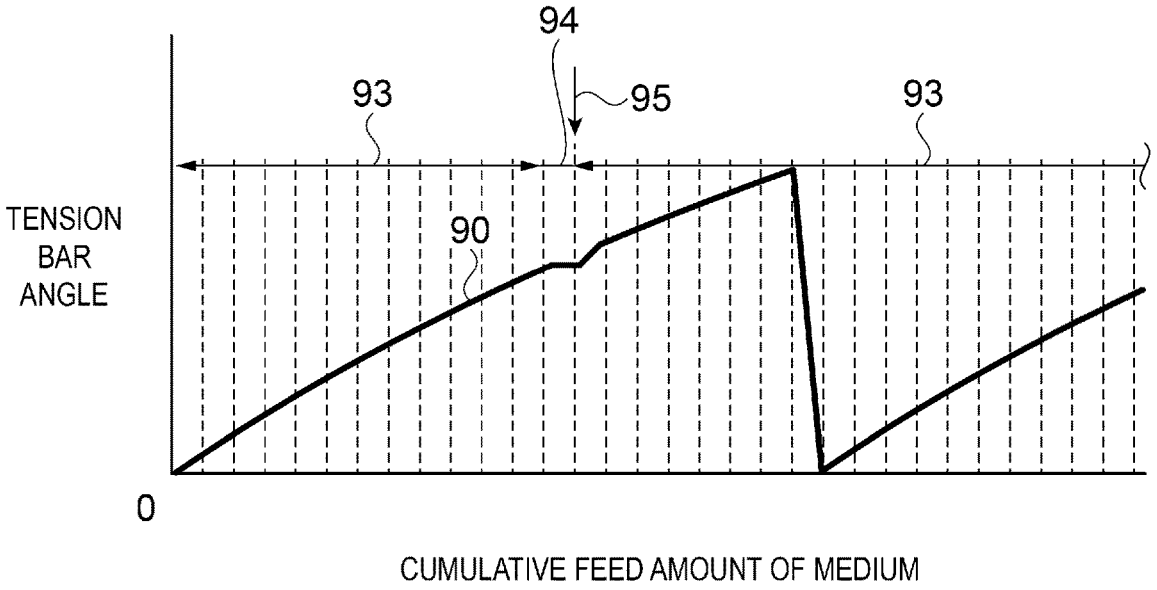
FIG. 19 is a drawing for describing the printing method.

FIG. 19 illustrates the angle transition line 90 after the pressing force applied by the tension bar 30 on the printing medium 17 is increased. The vertical axis and the horizontal axis are identical to those of FIG. 12. The angle transition line 90 indicates a state where the printing medium 17 does not adhere to the downstream side guide part 18 as a result of the increase of the pressing force applied by the tension bar 30 on the printing medium 17 in the determination timing 95.

Figure 20:
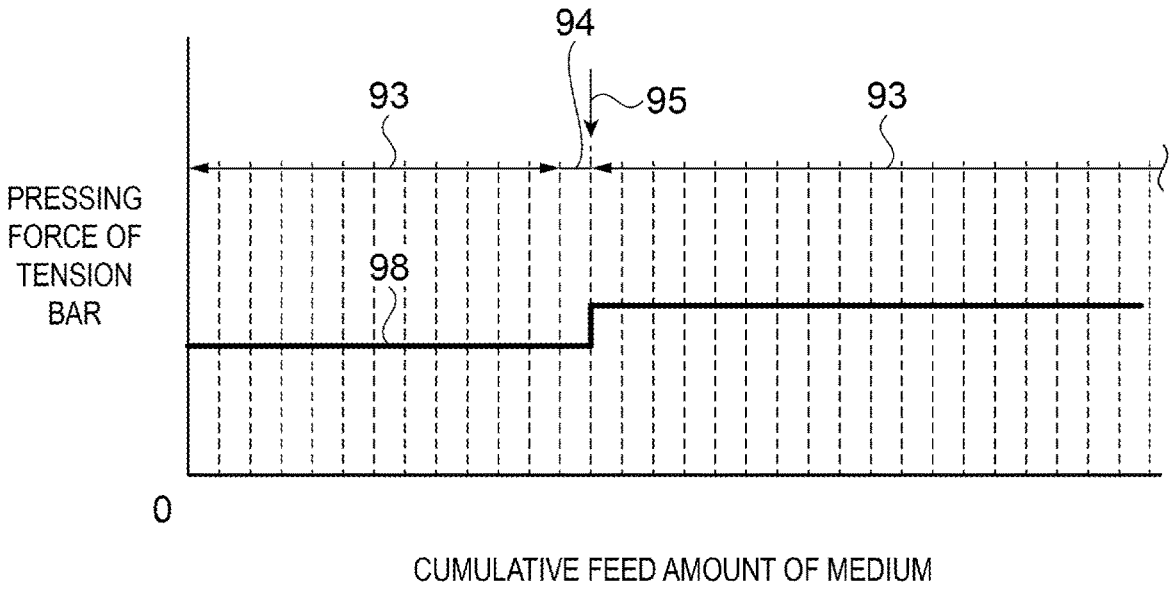
FIG. 20 is a drawing for describing the printing method.

FIG. 20 illustrates the pressing force transition line 98 after the pressing force applied by the tension bar 30 on the printing medium 17 is increased. The vertical axis and the horizontal axis are identical to those of FIG. 18. As indicated by the pressing force transition line 98, the pressing force is intensified after the determination timing 95 so as to maintain the pressing force applied on the printing medium 17 even in the normal region 93. That is, when no transportation failure of the printing medium 17 is detected after the force applied by the tension applying unit 29 to press the printing medium 17 has been intensified, the tension control unit 78 controls the tension applying motor 53 to maintain the intensified force applied to press the printing medium 17.

Figure 21:
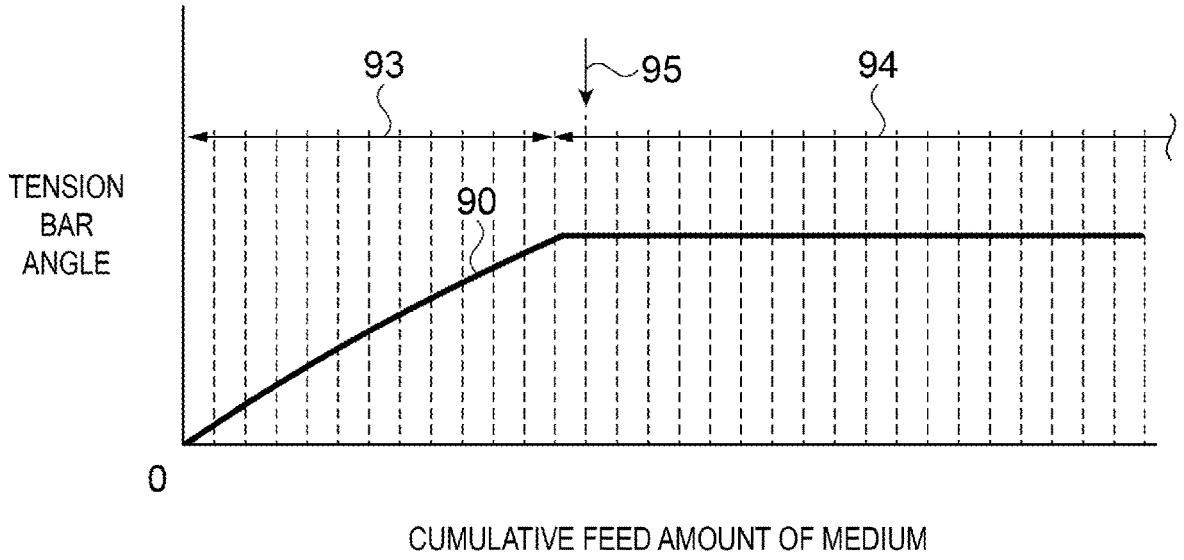
FIG. 21 is a drawing for describing the printing method.

FIG. 21 illustrates the angle transition line 90 after the pressing force applied by the tension bar 30 on the printing medium 17 is increased. The vertical axis and the horizontal axis are identical to those of FIG. 12. The angle transition line 90 indicates that a state where the printing medium 17 adheres to the downstream side guide part 18 is maintained even after the pressing force applied by the tension bar 30 on the printing medium 17 is increased at the determination timing 95.

Figure 22:
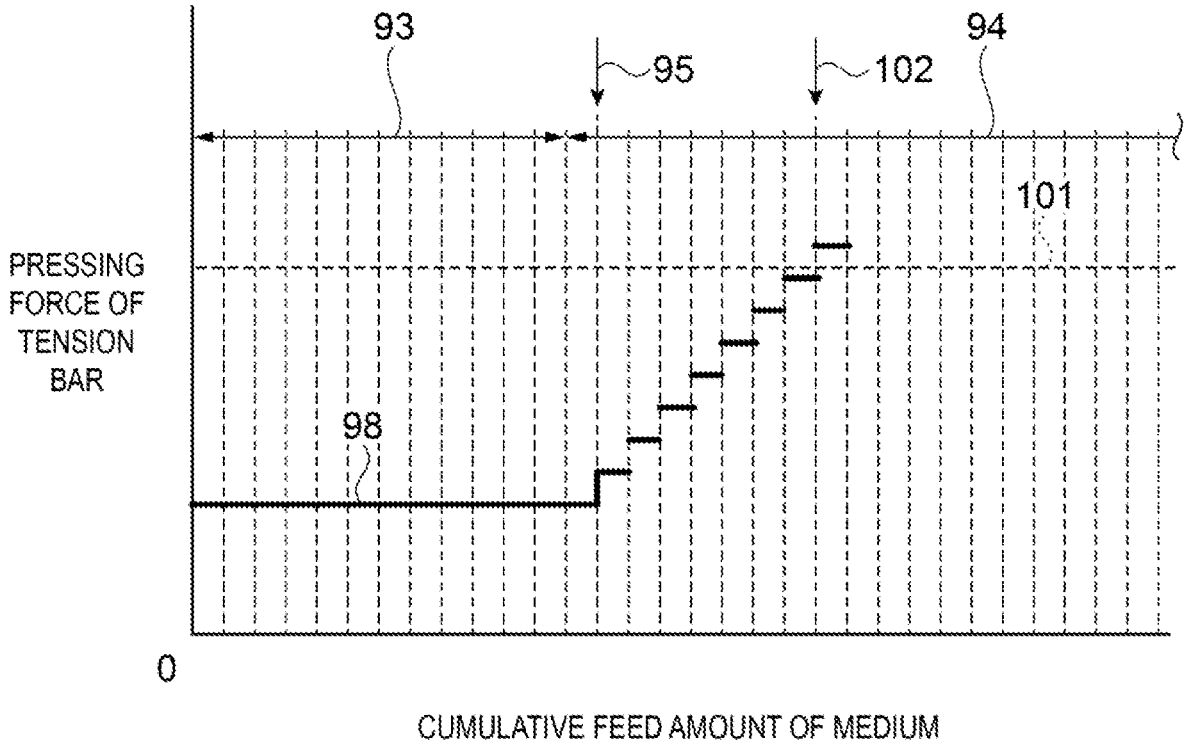
FIG. 22 is a drawing for describing the printing method.

FIG. 22 illustrates the pressing force transition line 98 after the pressing force applied by the tension bar 30 on the printing medium 17 is increased. The vertical axis and the horizontal axis are identical to those of FIG. 20. As indicated by the pressing force transition line 98, the pressing force is in the abnormality region 94 even when the pressing force is intensified after the determination timing 95. That is, the printing medium 17 is still adhered to the guide member 34.

At this time, step S6, step S9 and step S10 are performed continuously. As a result, the pressing force applied by the tension bar 30 on the printing medium 17 is increased for each rotation of the transportation driving roller 36*a*. In this manner, when a transportation failure of the printing medium 17 is detected, the tension control unit 78 controls the tension applying motor 53 to cause the force applied by the tension applying unit 29 to press the printing medium 17 to be greater than the force at the time when the transportation failure of the printing medium 17 has been detected. When the adhesion power of the printing medium 17 to the guide member 34 is relatively small, the printing medium 17 can be detached from the guide member 34 by increasing the tension of the printing medium 17.

Then, at an abnormality determination timing 102 when the pressing force applied by the tension bar 30 on the printing medium 17 exceeds the pressing force determination value 101, the process proceeds from step S9 to step S11. Thereafter, the CPU 57 drives the notification unit 12 to terminate the printing process.

As described above, according to the present exemplary embodiment, the following advantages are achieved.

(1) According to the present exemplary embodiment, the transporting unit 39 transports the printing medium 17 along the guide member 34. The transporting unit encoder 41 detects the movement amount of the printing medium 17 and outputs movement amount information indicating the movement amount of the printing medium 17 to the transportation failure detecting unit 86. The medium winding unit 26 is disposed downstream of the transporting unit 39 in the guide member 34. At a location between the transporting unit 39 and the medium winding unit 26, the tension bar 30 of the tension applying unit 29 presses the printing medium 17 to apply tension to the printing medium 17. By applying tension to the printing medium 17, the medium winding unit 26 can wind the printing medium 17 with high quality.

The tension applying unit encoder 54 detects the position of the tension bar 30 and outputs rod member location information indicating the position of the tension bar 30 to the transportation failure detecting unit 86. When the transporting unit 39 transports the printing medium 17, the tension of the printing medium 17 is reduced in a period until the medium winding unit 26 operates. When the tension bar 30 applies tension to the printing medium 17, the position of the tension bar 30 moves. Movement amount information and rod member location information are input to the transportation failure detecting unit 86. The transportation failure detecting unit 86 determines the movement amount of the printing medium 17 at the transporting unit 39 on the basis of the movement amount information. Further, the transportation failure detecting unit 86 recognizes the moving state of the printing medium 17 at the tension applying unit 29 on the basis of the rod member location information.

Thus, the transportation failure detecting unit 86 can detect the movement state of the printing medium 17, which indicates whether the printing medium 17 is moving at the tension applying unit 29 when the transporting unit 39 is moving the printing medium 17. When the printing medium 17 adheres to the guide member 34, the printing medium 17 does not move at the tension applying unit 29. At this time, the transportation failure detecting unit 86 determines that the printing medium 17 is not moving at the tension applying unit 29 and the printing medium 17 is moving at the transporting unit 39. As a result, the printing apparatus 1 can detect the transportation failure of the printing medium 17.

(2) According to the present exemplary embodiment, the movement amount computation unit 82 detects the transporting length of the printing medium 17 transported by the transporting unit 39. Then, when the transporting length of the printing medium 17 transported by the transporting unit 39 becomes equal to the length corresponding to one rotation amount of the transportation driving roller 36*a*, the bar position computation unit 84 detects the movement amount of the tension bar 30. Then, when the variation of the tension bar angle 88 is smaller than the determination value 96, a transportation failure of the printing medium 17 is detected.

The transportation failure detecting unit 86 determines a transportation failure of the printing medium 17 by using only the variation of the tension bar angle 88 without computing the variation of the movement amount of the printing medium 17 on the basis of the product of the variation of the tension bar angle 88 and the distance of the tension bar 30 from the first shaft 46*a* (the second shaft 47*a*). Thus, the transportation failure detecting unit 86 can save the time required for computing the movement amount of the printing medium 17, and therefore can detect a transportation failure in a short time.

(3) According to the present exemplary embodiment, the medium winding unit 26 controls the winding amount of the printing medium 17. Then, the printing medium 17 is caused to pass through at a location where the tension bar 30 can press the printing medium 17. When the amount of the printing medium 17 that is wound by the medium winding unit 26 is small, the printing medium 17 slackens, and consequently the tension bar 30 cannot press the printing medium 17. When the medium winding unit 26 winds the printing medium 17 such that the printing medium 17 is not slackened, the tension bar 30 can press the printing medium 17. Further, the tension bar 30 can be moved in accordance with the movement of the printing medium 17.

(4) According to the present exemplary embodiment, the printing apparatus 1 includes the tension applying motor 53 that drives the tension applying unit 29. When the transportation failure detecting unit 86 detects a transportation failure of the printing medium 17, the tension control unit 78 causes the tension applying motor 53 to intensify the force applied by the tension applying unit 29 to press the printing medium 17. When the adhesion power of the printing medium 17 to the guide member 34 is small, the printing medium 17 can be detached from the guide member 34 by increasing the tension of the printing medium 17.

(5) According to the present exemplary embodiment, when no transportation failure of the printing medium 17 is detected, the tension control unit 78 causes the tension applying motor 53 to maintain the force applied by the tension applying unit 29 to press the printing medium 17 at a high value. Thus, since strong tension is applied to the printing medium 17, the adhesion of the printing medium to the guide member again can be reduced.

(6) According to the present exemplary embodiment, the tension applying unit 29 presses the tension bar 30 against the printing medium 17 so as to apply tension to the printing medium 17 at a location between the transporting unit 39 and the medium winding unit 26. By applying tension to the printing medium 17, the medium winding unit 26 can implement high quality winding of the printing medium 17. When the transporting unit 39 transports the printing medium 17, the tension of the printing medium 17 is reduced at a location downstream of the transporting unit 39. When the tension bar 30 applies tension to the printing medium 17, the position of the tension bar 30 moves. The transportation failure detecting unit 86 receives movement amount information and rod member location information. The transportation failure detecting unit 86 receives the movement amount information and recognizes the movement amount of the printing medium 17 at the transporting unit 39. Further, the transportation failure detecting unit 86 receives the rod member location information and recognizes the degree of the movement of the printing medium 17 at the tension applying unit 29.

Thus, the transportation failure detecting unit 86 can detect the movement state of the printing medium 17, which indicates whether the printing medium 17 is moving at the tension applying unit 29 when the transporting unit 39 is moving the printing medium 17. When the printing medium 17 adheres to the guide member 34, the printing medium 17 does not move at the tension applying unit 29. At this time, the transportation failure detecting unit 86 determines that the printing medium 17 is not moving at the tension applying unit 29 and the printing medium 17 is moving at the transporting unit 39. As a result, the printing apparatus 1 can detect the transportation failure of the printing medium 17.

Second Exemplary Embodiment

Next, an exemplary embodiment of the printing apparatus is described with reference to FIG. 23 to FIG. 25. The present exemplary embodiment differs from the first exemplary embodiment in that a tension reducing process of step S12 is performed after the winding process of step S7 illustrated in FIG. 6. Note that, the descriptions for the points identical to those of the first exemplary embodiment are omitted.

Figure 23:
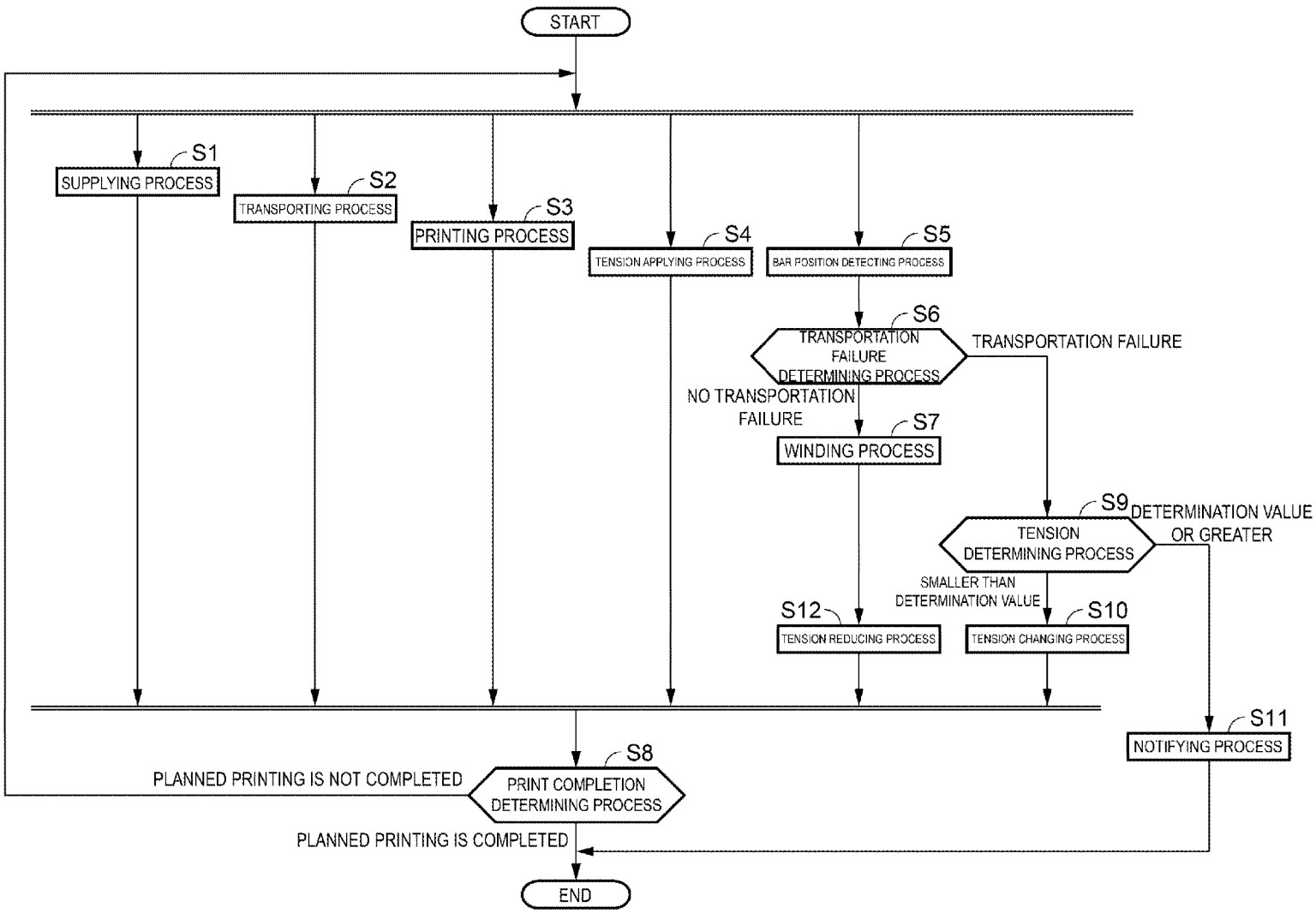
FIG. 23 is a flowchart of a printing method according to a second exemplary embodiment.

FIG. 23 is a flowchart of a printing method. That is, in the present exemplary embodiment, the tension reducing process of step S12 is performed after the winding process of step S7 as illustrated in FIG. 23.

When it is determined that there is no transportation failure at the transportation failure determining process of step S6, the process proceeds to step S7. At the winding process of step S7, the medium winding unit 26 winds the printing medium 17. Next, the process proceeds to step S12. Step S12 is a tension reducing process. In this process, the force applied by the tension bar 30 to press the printing medium 17 is returned to the force at the time when the transportation failure of the printing medium 17 has been detected. Next, the process proceeds to step S8.

Figure 24:
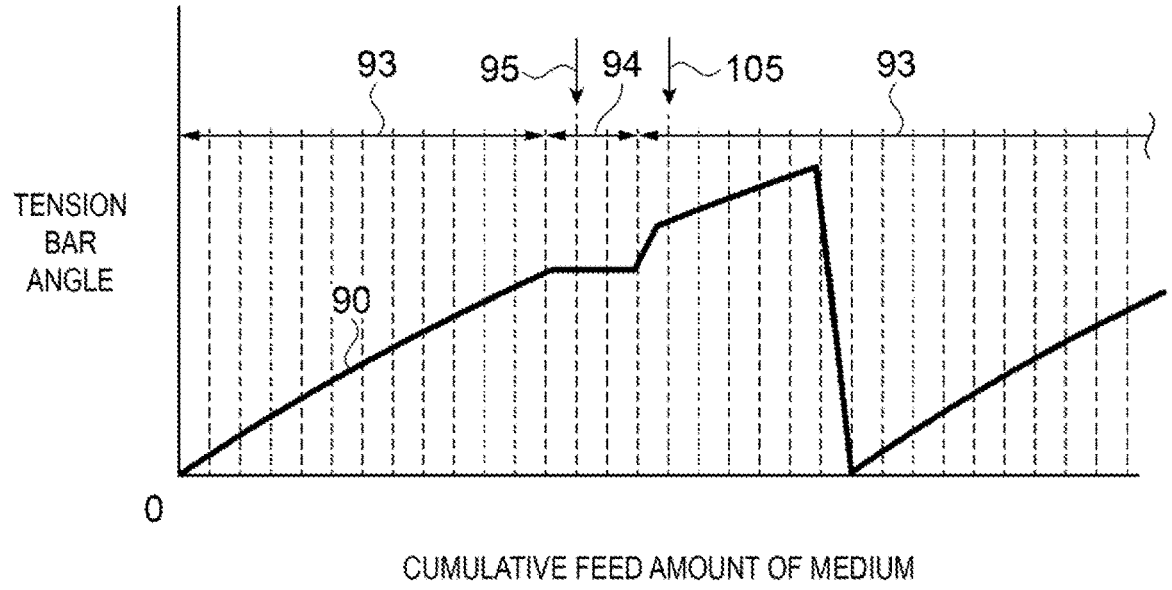
FIG. 24 is a drawing for describing the printing method.
Figure 25:
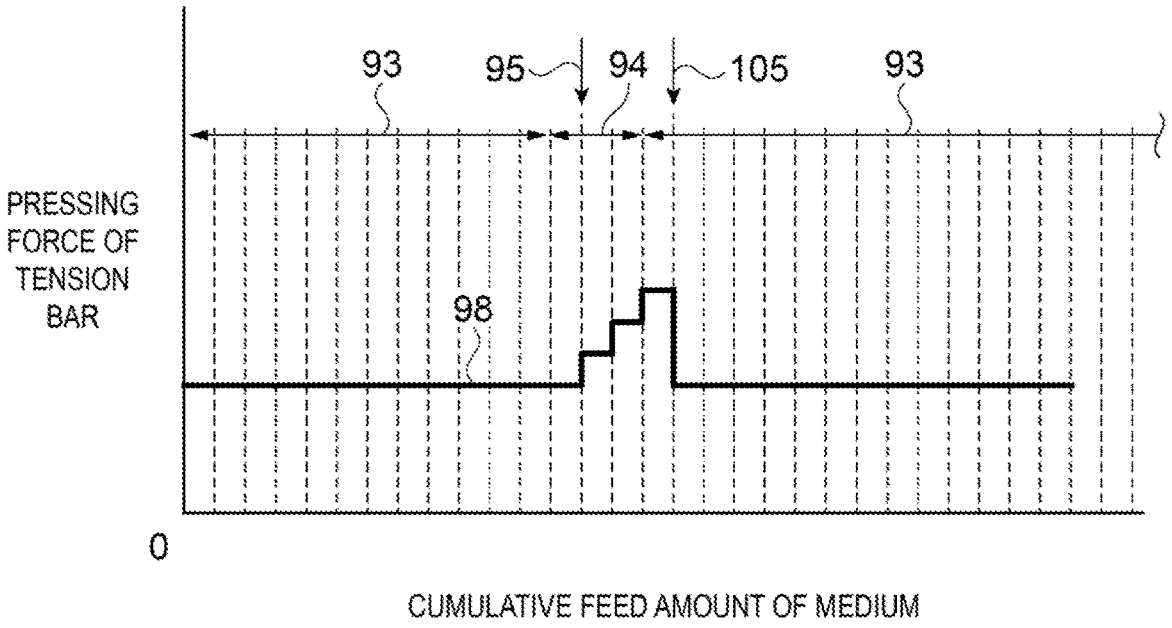
FIG. 25 is a drawing for describing the printing method.

FIG. 24 and FIG. 25 are drawings for describing a printing method. Next, with reference to FIG. 24 and FIG. 25, a printing method will be described in detail in correspondence with the steps illustrated in FIG. 23. FIG. 24 illustrates the angle transition line 90 after the pressing force applied by the tension bar 30 on the printing medium 17 is increased. The vertical axis and the horizontal axis are identical to those of FIG. 12. At the determination timing 95, the pressing force applied by the tension bar 30 on the printing medium 17 is increased.

The transportation failure continues while the transportation driving roller 36*a* rotates two times after the determination timing 95. Then, when the transportation driving roller 36*a* has rotated two and half times after the determination timing 95, the transportation failure is eliminated and the tension bar 30 rotates. That is, the tension bar 30 moves to the medium winding unit 26 side.

In the transportation failure determining process of step S6 at a determination timing 105 after the transportation failure is eliminated, the transportation failure detecting unit 86 determines that there is no transportation failure. Next, the process proceeds to the winding step of step S7. In the winding process, the tension applying unit 29 has not reached the lower limit position 30*b*, and therefore winding of the printing medium 17 is not performed. Accordingly, the tension bar angle 88 increases.

FIG. 25 illustrates the pressing force transition line 98 after the pressing force applied by the tension bar 30 on the printing medium 17 is increased. The vertical axis and the horizontal axis are identical to those of FIG. 18. As the pressing force transition line 98 indicates, the force applied by the tension bar 30 to press the printing medium 17 is intensified after the determination timing 95. In the abnormality region 94, the force applied to press the printing medium 17 is increased for each rotation of the transportation driving roller 36*a*. In the present exemplary embodiment, a tension bar pressing force, which is the force applied by the tension bar 30 to press the printing medium 17, is increased in three levels.

Then, at step S12, at the determination timing 105 when the normal region 93 is set, the pressing force applied on the printing medium 17 is reset to the original state. That is, when no transportation failure of the printing medium 17 is detected after the force applied by the tension applying unit 29 to press the printing medium 17 has been intensified, the tension control unit 78 controls the tension applying motor 53 to return the force applied to press the printing medium 17 to the force at the time when the transportation failure of the printing medium 17 has been detected. Next, the process proceeds to step S8.

As described above, according to the present exemplary embodiment, the following advantages are achieved.

(1) According to the present exemplary embodiment, when no transportation failure of the printing medium 17 is detected, the tension control unit 78 causes the tension applying motor 53 to weaken the pressing force of the tension bar 30 to return the force applied by the tension applying unit 29 to press the printing medium 17 to the original force. Thus, when the printing medium 17 is easily applied by strong tension, deformation of graphics printed on the printing medium 17 can be reduced.

Note that, the present exemplary embodiment is not limited to the above-described exemplary embodiment, it should be understood by those skilled in the art that various modifications and alterations may occur in so far as they are within the spirit and technical scope of the present disclosure. Such modified examples are described below.

Modified Example 1

Figure 26:
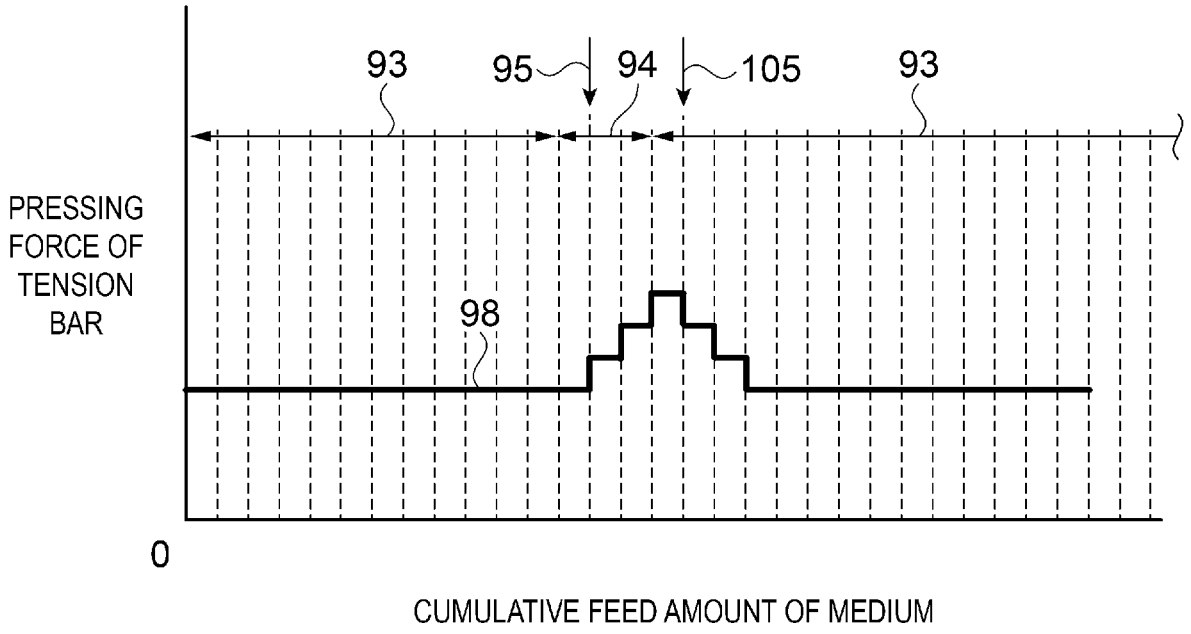
FIG. 26 is a drawing for describing a printing method according to a modification.

In the second exemplary embodiment, the tension bar pressing force is increased in three levels at the determination timing 95. FIG. 26 is a drawing for describing a printing method, and illustrates the pressing force transition line 98 after the pressing force applied by the tension bar 30 on the printing medium 17 is increased. The vertical axis and the horizontal axis are identical to those of FIG. 18. As indicated by the pressing force transition line 98, in the present modification, the tension bar pressing force, which is the force applied by the tension bar 30 to press the printing medium 17, has been intensified in three levels.

Then, at the determination timing 105 at step S12 after the normal region 93 is set, the level of the pressing force applied on the printing medium 17 is reduced one by one to reset the state to the original state. By gradually changing the pressing force in this manner, the influence of the tension bar 30 on the printing medium 17 can be reduced.

Modified Example 2

In the first exemplary embodiment, one type of the printing medium 17 is used. In the printing apparatus 1, printing may be performed on multiple types of the printing mediums 17 by replacing the printing mediums 17. At this time, the determination data 73 and the tension-related data 74 stored in the memory 58 may be set for each the printing medium 17. FIG. 27 illustrates determination data and tension-related data of printing mediums. In the table of FIG. 27, examples of the item names of the elements are described in the first line, and examples of data are described in the second and subsequent lines.

The medium names are described in the first column of the table. Names for distinguishing the printing mediums 17 are described as the medium names. The materials are described in the second column of the table. The names of the materials of the printing mediums 17 are described as the materials. In a case that the printing medium 17 is a laminated medium of a plurality of sheets, the names of a plurality of materials are described.

The thickness is described in the third column of the table. The load-bearing capacity of the printing medium 17 differs depending on the thickness. The angle variation determination value is described in the fourth column of the table. The angle variation determination value corresponds to the determination value 96 of FIG. 17. The pressing force determination value is described in the fifth column of the table. The pressing force determination value corresponds to the pressing force determination value 101 of FIG. 18. The pressing force increase amount is described in the sixth column of the table. The pressing force increase amount is the increase of the pressing force applied by the tension bar 30 on the printing medium 17 for each rotation of the transportation driving roller 36*a* in the abnormality region 94 of FIG. 25.

The pressing force reduction pattern is described in the seventh column of the table. The pressing force reduction pattern is a reduction pattern of the pressing force applied by the tension bar 30 on the printing medium 17 for each rotation of the transportation driving roller 36*a* after shifting from the abnormality region 94 to the normal region 93. The type in which the tension bar pressing force is maintained even after shifting from the abnormality region 94 to the normal region 93 as in FIG. 20 of the first exemplary embodiment is "1". The type in which the tension bar pressing force is immediately reset to the original state after shifting from the abnormality region 94 to the normal region 93 as in FIG. 25 of the second exemplary embodiment is "2". The type in which the tension bar pressing force is reset to the original state stepwise after shifting from the abnormality region 94 to the normal region 93 as in FIG. 26 of modification 1 is "3".

The determination data 73 and the tension-related data 74 as those described in the table is provided in the memory 58 for each medium name. The transportation failure detecting unit 86 and the tension control unit 78 perform determination and control with reference to the determination data 73 and the tension-related data 74. In this manner, the determination data 73 and the tension-related data 74 are set in association with the material and the thickness of the printing medium 17. Thus, the damage of the printing medium 17 by an excessively strong tension bar pressing force can be reduced.

Modified Example 3

In the first exemplary embodiment, the movement amount computation unit 82 computes the movement amount of the printing medium 17 by multiplying the rotation angle of the rotation shaft of the transportation motor 38 with a predetermined coefficient. Then, the transportation failure detecting unit 86 detects a transportation failure with reference to the movement amount of the printing medium 17. The transportation failure detecting unit 86 may receive data of the rotation angle of the rotation shaft of the transportation motor 38 output by the transporting unit encoder 41. Further, the transportation failure detecting unit 86 may detect a transportation failure with reference to the rotation angle of the rotation shaft of the transportation motor 38. Since the time for computing the movement amount of the printing medium 17 can be saved, the time for detecting a transportation failure can be shortened.

Contents derived from the exemplary embodiments will be described below.

A printing apparatus includes: a transporting unit configured to transport a medium along a guide member; a winding unit disposed further downstream of the guide member than the transporting unit and configured to wind the medium; a tension applying unit including a rod member configured to press the medium between the transporting unit and the winding unit and apply tension to the medium while moving between an upper limit position and a lower limit position; and a control unit including a first detecting unit configured to detect a movement amount of the medium, and a second detecting unit configured to detect a movement amount of the rod member, and the control unit detects the movement amount of the rod member every time the transporting unit transports the medium by a predetermined length, and detects a transportation failure of the medium when the movement amount of the rod member is smaller than a determination value.

With this configuration, the transporting unit transports the medium along the guide member. The winding unit is disposed on the downstream side of the transporting unit and the guide member in the movement direction of the medium. The downstream side is the traveling direction side when the medium moves. Then, the rod member of the tension applying unit between the transporting unit and the winding unit presses the medium to apply tension to the medium. By applying tension to the medium, the winding unit can implement high quality winding of the medium.

The control unit includes a first detecting unit and a second detecting unit. Then, the first detecting unit detects the movement amount of the medium. Then, the second detecting unit detects the movement amount of the rod member. When the transporting unit transports the medium, the tension of the medium is reduced until the winding unit operates. Then, when the rod member applies tension to the medium, the position of the rod member changes. The control unit determines the movement amount of the medium at the transporting unit on the basis of the movement amount information. Further, the control unit recognizes the degree of the movement of the medium (medium movement state) at the tension applying unit on the basis of the rod member location information.

Thus, the control unit can detect the medium movement state, which indicates whether the medium is moving at the tension applying unit when the transporting unit is moving the medium. When the medium adheres to the guide member, the medium does not move at the tension applying unit. At this time, the control unit determines that the medium is moving at the transporting unit and the medium is not moving at the tension applying unit. Specifically, when the transporting length of the medium transported by the transporting unit becomes equal to a predetermined length, the control unit detects the movement amount of the rod member. Then, when the movement amount of the rod member is smaller than a determination value, a transportation failure of the medium is detected. As a result, the printing apparatus can detect a transportation failure of the medium.

Preferably, in the printing apparatus, a winding amount of the medium wound by the winding unit is controlled such that the medium passes through a location where the rod member is able to press the medium.

With this configuration, the winding amount of the medium wound by the winding unit is controlled. Then, the medium is caused to pass through a location where the rod member is capable of pressing the medium. When the amount of the medium wound by the winding unit is small, the medium slackens, and consequently the rod member cannot press the medium. Since the winding unit winds the medium before the medium slackens, the rod member can press the medium. Thus, the rod member can be moved in accordance with the movement of the medium.

Preferably, the printing apparatus includes a driving unit configured to drive the tension applying unit, and when a transportation failure of the medium is detected, the control unit controls the driving unit such that a force that the tension applying unit applies to press the medium becomes greater than a force that has been applied at a time of detecting the transportation failure of the medium.

In this configuration, the printing apparatus includes a driving unit that drives the tension applying unit. When the control unit detects a transportation failure of the medium, the control unit causes the driving unit to intensify the force applied by the tension applying unit to press the medium. When the adhesion power of the medium to the guide member is small, the medium can be detached from the guide member by increasing the tension of the medium.

Preferably, in the printing apparatus, when no transportation failure of the medium is detected after the tension applying unit has intensified the force applied to press the medium, the control unit controls the driving unit to maintain the intensified force to press the medium.

With this configuration, when no transportation failure of the medium is detected, the control unit causes the driving unit to maintain the intensified force applied by the tension applying unit to press the medium. Thus, since strong tension is applied to the medium, the medium adhering to the guide member again can be reduced.

Preferably, in the printing apparatus, when no transportation failure of the medium is detected after the tension applying unit has intensified the force applied to press the medium, the control unit controls the driving unit such that the force applied to press the medium returns to the force that has been applied at the time detecting the transportation failure of the medium.

With this configuration, when no transportation failure of the medium is detected, the control unit causes the driving unit to weaken the force applied by the tension applying unit to press the medium to return to the original force. Thus, in the case that the medium to which strong tension is applied is easily extended, deformation of graphics printed on the medium can be reduced.

A printing method includes: transporting a medium along a guide member by a transporting unit; winding the medium by a winding unit further downstream of the guide member than the transporting unit; pressing the medium, between the transporting unit and the winding unit, by a rod member to apply tension to the medium while moving between an upper limit position and a lower limit position; detecting a movement amount of the medium by a first detecting unit; and detecting a movement amount of the rod member by a second detecting unit. The movement amount of the rod member is detected every time the transporting unit transports the medium by a predetermined length, and a transportation failure of the medium is detected when the movement amount of the rod member is smaller than a determination value.

According to the method, the transporting unit transports the medium along the guide member. The winding unit winds the medium the downstream side of the guide member with respect to the transporting unit. The rod member applies tension to the medium by pressing the medium while moving between the upper limit position and the lower limit position at a location between the transporting unit and the winding unit. By applying tension to the medium, the winding unit can implement high quality winding of the medium.

When the transporting unit transports the medium, the tension of the medium is reduced. Then, the position of the rod member moves when the rod member applies tension to the medium. The first detecting unit detects the movement amount of the medium, and the second detecting unit detects the movement amount of the rod member. The control unit detects the movement amount of the rod member at every time when the transporting unit transports the medium by a predetermined length.

Thus, the control unit can detect the medium movement state, which indicates whether the medium is moving at the tension applying unit when the transporting unit is moving the medium. When the medium adheres to the guide member, the medium does not move at the tension applying unit. At this time, the medium is moving at the transporting unit, and the medium is not moving at the tension applying unit. Then, when the movement amount of the rod member is smaller than a determination value, the control unit detects a transportation failure of the medium. As a result, the printing apparatus can detect a transportation failure of the medium.

What is claimed is:

1. A printing apparatus comprising:

a transporting unit configured to transport a medium along a guide member;

a winding unit disposed downstream of the guide member with respect to the transporting unit and configured to wind the medium;

a tension applying unit including a rod member configured to press the medium between the transporting unit and the winding unit, and the rod member configured to apply tension to the medium while moving between an upper limit position and a lower limit position; and a control unit including a first detecting unit configured to detect a movement amount of the medium, and a second detecting unit configured to detect a movement amount of the rod member, wherein the control unit detects the movement amount of the rod member every time the transporting unit transports the medium by a predetermined length, and detects a transportation failure of the medium when the movement amount of the rod member is smaller than a determination value.

2. The printing apparatus according to claim 1, wherein a winding amount of the medium wound by the winding unit is controlled such that the medium passes through a location where the rod member is configured to press the medium.

3. The printing apparatus according to claim 1, comprising a driving unit configured to drive the tension applying unit, wherein when a transportation failure of the medium is detected, the control unit controls the driving unit such that a force in which the tension application unit presses the medium becomes greater than a force when the transportation failure of the medium has been detected.

4. The printing apparatus according to claim 3, wherein when the transportation failure of the medium is not detected after intensifying the force in which the tension applying unit presses the medium, the control unit controls the driving unit to maintain the force intensified.

5. The printing apparatus according to claim 3, wherein when the transportation failure of the medium is not detected after intensifying the force in which the tension applying unit presses the medium, the control unit controls the driving unit such that the force in which the tension applying unit presses the medium returns to the force when the transportation failure of the medium has been detected.

6. A printing method comprising:

transporting a medium along a guide member by a transporting unit;

winding the medium by a winding unit downstream of the guide member with respect to the transporting unit;

pressing the medium, between the transporting unit and the winding unit, by a rod member to apply tension to the medium while moving between an upper limit position and a lower limit position;

detecting a movement amount of the medium by a first detecting unit; and detecting a movement amount of the rod member by a second detecting unit, wherein a control unit detects the movement amount of the rod member every time the transporting unit transports the medium by a predetermined length, and detects a transportation failure of the medium when the movement amount of the rod member is smaller than a determination value.

* * * * *